US009615178B2

(12) United States Patent
Fukami et al.

(10) Patent No.: US 9,615,178 B2
(45) Date of Patent: Apr. 4, 2017

(54) SOUND GENERATOR

(71) Applicant: KYOCERA CORPORATION, Kyoto (JP)

(72) Inventors: Satoshi Fukami, Kawasaki (JP); Hiroshi Taimura, Yokohama (JP); Kazuchika Suzuki, Kawasaki (JP); Seiji Horii, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 14/502,403

(22) Filed: Sep. 30, 2014

(65) Prior Publication Data

US 2015/0117684 A1 Apr. 30, 2015

(30) Foreign Application Priority Data

Oct. 30, 2013 (JP) ..... 2013-225418
Dec. 24, 2013 (JP) ..... 2013-265930
Mar. 27, 2014 (JP) ..... 2014-066653

(51) Int. Cl.
*H04R 25/00* (2006.01)
*H04R 17/00* (2006.01)
(Continued)

(52) U.S. Cl.
CPC ..... *H04R 17/00* (2013.01); *B06B 1/0207* (2013.01); *B06B 1/0603* (2013.01); *B06B 1/0611* (2013.01); *B06B 1/10* (2013.01); *H04R 3/04* (2013.01); *H04R 2499/11* (2013.01); *H04R 2499/15* (2013.01)

(58) Field of Classification Search
USPC ..... 381/190, 173
See application file for complete search history.

(56) References Cited

U.S. PATENT DOCUMENTS 4,985,926 A * 1/1991 Foster ..... H04R 17/00 310/366
6,188,442 B1 * 2/2001 Narayanaswami ..... H04N 5/44 345/7

(Continued)

FOREIGN PATENT DOCUMENTS

JP 05-085192 U 11/1993
JP 2007-74663 A 3/2007

(Continued)

OTHER PUBLICATIONS

An Office Action; "Notice of Reasons for Rejection," issued by the Japanese Patent Office on Sep. 20, 2016, which corresponds to Japanese Patent Application No. 2013-225411 and is related to U.S. Appl. No. 14/502,403; with English language concise explanation.

(Continued)

*Primary Examiner* — Amir Etesam
(74) *Attorney, Agent, or Firm* — Studebaker & Brackett PC

(57) ABSTRACT

A sound generator includes a housing (20), a piezoelectric vibrator (60) including a piezoelectric element (61), at least a portion of the piezoelectric vibrator (60) protruding from the housing (20), and an anchor (10) applying a load to the piezoelectric vibrator (60). A portion or all of the piezoelectric vibrator (60) withdraws into the housing (20) under a force of a predetermined load or greater. While the load from the anchor (10) is being applied to the piezoelectric vibrator (60), the piezoelectric vibrator (60) deforms in response to a sound signal, and deformation of the piezoelectric vibrator (60) vibrates a contact surface contacted by the piezoelectric vibrator (60), causing sound to be emitted from the contact surface.

13 Claims, 33 Drawing Sheets

(51) Int. Cl.

| | |
|---|---|
| ***B06B 1/06*** | (2006.01) |
| ***B06B 1/02*** | (2006.01) |
| ***B06B 1/10*** | (2006.01) |
| *H04R 3/04* | (2006.01) |

(56) References Cited

U.S. PATENT DOCUMENTS

| | | | | |
|---|---|---|---|---|
| 7,382,079 | B2 | 6/2008 | Kawase et al. | |
| 2007/0041595 | A1* | 2/2007 | Carazo | H04R 17/00 381/151 |
| 2007/0057601 | A1 | 3/2007 | Kawase et al. | |
| 2008/0044042 | A1* | 2/2008 | Liu | H04R 9/00 381/150 |
| 2010/0111340 | A1* | 5/2010 | Miller | H04R 1/326 381/322 |
| 2011/0133606 | A1* | 6/2011 | Yoshida | H02N 2/004 310/356 |
| 2012/0281345 | A1 | 11/2012 | Masaki et al. | |

FOREIGN PATENT DOCUMENTS

| | | | |
|---|---|---|---|
| JP | 2009-053502 | A | 3/2009 |
| JP | 2011-071691 | A | 4/2011 |
| JP | 2011-141330 | A | 7/2011 |
| JP | 2011-175127 | A | 9/2011 |
| JP | 2011-182368 | A | 9/2011 |
| JP | 2012-103520 | A | 5/2012 |
| JP | 2013-009236 | A | 1/2013 |
| JP | 2013-077002 | A | 4/2013 |
| JP | 2013-223213 | A | 10/2013 |

OTHER PUBLICATIONS

An Office Action; "Notice of Reasons for Rejection," issued by the Japanese Patent Office on Sep. 20, 2016, which corresponds to Japanese Patent Application No. 2013-225413 and is related to U.S. Appl. No. 14/502,403; with English language concise explanation.

An Office Action; "Notice of Reasons for Rejection," issued by the Japanese Patent Office on Sep. 20, 2016, which corresponds to Japanese Patent Application No. 2013-225415 and is related to U.S. Appl. No. 14/502,403; with English language concise explanation.

An Office Action; "Notice of Reasons for Rejection," issued by the Japanese Patent Office on Dec. 20, 2016, wich corresponds to Japanese Patent Application No. 2013-265928 and is related to U.S. Appl. No. 14/502,403; with English language concise explanation.

JP Office Action dated Nov. 29, 2016 from corresponding JP Appl No. 2013-266027, with concise statement of relevance, 5 pages.

* cited by examiner

SOUND GENERATOR

CROSS-REFERENCE TO RELATED APPLICATIONS

This application claims priority to and the benefit of Japanese Patent Application No. 2013-225418 filed Oct. 30, 2013, Japanese Patent Application No. 2013-265930 filed Dec. 24, 2013, and Japanese Patent Application No. 2014-066653 filed Mar. 27, 2014, the entire contents of which are incorporated herein by reference.

TECHNICAL FIELD

The present invention relates to a sound generator that vibrates a contact surface with which the sound generator is in contact, causing sound to be emitted from the contact surface.

BACKGROUND

A known electronic device, such as a mobile phone, generates sound from a speaker provided in the electronic device. A dynamic speaker is mainly used as the speaker in the electronic device. For example, the vibration generating device disclosed in Patent Literature 1 has a dynamic speaker configuration provided with a magnet, a voice coil, and a diaphragm, as well as a case housing these elements.

CITATION LIST

Patent Literature 1: JP H05-085192 U

SUMMARY

Since the vibration generating device disclosed in Patent Literature 1 has a dynamic speaker configuration, however, the number of components necessarily increases, and the device becomes heavier. Output from a dynamic speaker depends on the size of the diaphragm for generating sound. As the speaker is smaller, the output becomes smaller. Therefore, in order to obtain good sound characteristics, an increase in size of the device is unavoidable.

The present invention has been conceived in light of the above considerations and provides a sound generator that allows for a reduction in size and weight and can generate a good sound.

A sound generator according to the present invention includes: a housing; at least one piezoelectric vibrator including a piezoelectric element, at least a portion of the piezoelectric vibrator protruding from the housing; and an anchor applying a load to the piezoelectric vibrator, such that a portion or all of the piezoelectric vibrator withdraws into the housing under a force of a predetermined load or greater, and while the load from the anchor is being applied to the piezoelectric vibrator, the piezoelectric vibrator deforms in response to a sound signal, and deformation of the piezoelectric vibrator vibrates a contact surface contacted by the piezoelectric vibrator, causing sound to be emitted from the contact surface.

The predetermined load is preferably greater than the load applied to the piezoelectric vibrator by the anchor.

The load is preferably applied by the anchor to the piezoelectric vibrator through an elastic support member.

The elastic support member preferably deforms upon application, through the piezoelectric vibrator, of a force of the predetermined load or greater, and a portion or all of the piezoelectric vibrator preferably withdraws into the housing.

The piezoelectric element is preferably a laminated piezoelectric element that deforms by expanding and contracting along a lamination direction.

The piezoelectric vibrator preferably includes a cover member that vibrates the contact surface by transmitting vibration due to deformation of the piezoelectric element to the contact surface.

The at least one piezoelectric vibrator preferably includes a plurality of piezoelectric vibrators.

A sound generator according to the present invention includes: a housing; at least one piezoelectric vibrator including a piezoelectric element and selectively transitioning between a first state such that at least a portion of the piezoelectric vibrator protrudes from the housing and a second state such that the piezoelectric vibrator does not protrude from the housing; and an anchor applying a load to the piezoelectric vibrator, such that when the piezoelectric vibrator is in the first state and while the load from the anchor is being applied to the piezoelectric vibrator, upon the piezoelectric element deforming in response to a sound signal, the piezoelectric vibrator deforms and vibrates a contact surface contacted by the piezoelectric vibrator, causing sound to be emitted from the contact surface.

The piezoelectric element is preferably driven when the piezoelectric vibrator is in the first state and is preferably not driven when the piezoelectric vibrator is in the second state.

The sound generator preferably further includes: a lock mechanism to selectively maintain the piezoelectric vibrator in the first state or the second state.

When the piezoelectric vibrator is in the first state and a force of a predetermined load or greater acts on the piezoelectric vibrator protruding from the housing, the lock mechanism preferably releases the piezoelectric vibrator from the first state and displaces the piezoelectric vibrator towards the second state.

The sound generator preferably further includes: a state detection unit configured to detect the first state or the second state of the piezoelectric vibrator, such that driving of the piezoelectric element is controlled based on output from the state detection unit.

The piezoelectric element is preferably a laminated piezoelectric element that deforms by expanding and contracting along a lamination direction.

The piezoelectric vibrator preferably includes a cover member that vibrates the contact surface by transmitting vibration due to deformation of the piezoelectric element to the contact surface.

The at least one piezoelectric vibrator preferably includes a plurality of piezoelectric vibrators.

According to the present invention, it is possible to provide a sound generator that allows for a reduction in size and weight and can generate a good sound.

BRIEF DESCRIPTION OF DRAWINGS

The present invention will be further described below with reference to the accompanying drawings, wherein.

DESCRIPTION OF EMBODIMENTS

The following describes embodiments of the present invention with reference to the drawings.

Embodiment 1

Figure 1:
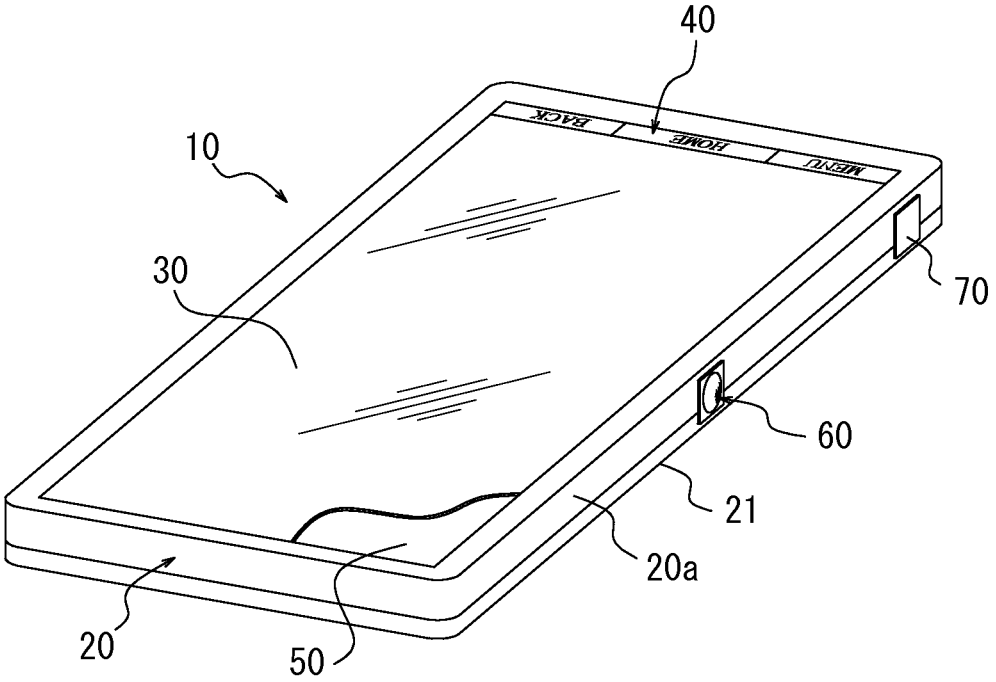
FIG. 1 is an external perspective view of a sound generator according to Embodiment 1 of the present invention.

FIG. 1 is an external perspective view of a sound generator according to Embodiment 1 of the present invention. The sound generator according to the present embodiment includes a mobile phone 10, such as a smartphone, a piezoelectric vibrator 60, and an elastic member 70. As described below, the mobile phone 10 acts as an anchor (the anchor in the sound generator) providing a load to the piezoelectric vibrator 60. The mobile phone 10 includes a housing 20 having an approximately rectangular external shape. In the housing 20, a panel 30 and an input unit 40 are provided at the front side of the mobile phone 10, and as illustrated by the partial cutout of the panel 30 in FIG. 1, a display unit 50 is held below the panel 30. A battery pack, camera unit, and the like are installed at the back side of the housing 20 and covered by a battery lid 21.

The panel 30 is configured using a touch panel that detects contact, a cover panel that protects the display unit 50, or the like and is, for example, made from glass or a synthetic resin such as acrylic or the like. The panel 30 is, for example, rectangular. The panel 30 may be a flat plate or may be a curved panel, the surface of which is smoothly inclined. When the panel 30 is a touch panel, the panel 30 detects contact by the user's finger, a pen, a stylus pen, or the like. Any detection system may be used in the touch panel, such as a capacitive system, a resistive film system, a surface acoustic wave system (or an ultrasonic wave system), an infrared system, an electromagnetic induction system, a load detection system, or the like. In the present embodiment, to simplify explanation, the panel 30 is a touch panel.

The input unit 40 accepts operation input from the user and may be configured, for example, using operation buttons (operation keys). The panel 30 can also accept operation input from the user by detecting contact by the user on a softkey or the like displayed on the display unit 50.

The display unit 50 is a display device such as a liquid crystal display, an organic EL display, an inorganic EL display, or the like.

The sound generator according to the present embodiment includes the piezoelectric vibrator 60 for a sound generator and the sheet-like elastic member 70 on a lateral side 20*a*, which is one of the long sides of the housing 20 in the mobile phone 10. The piezoelectric vibrator 60 partially protrudes from the lateral side 20*a*. The elastic member 70 may, for example, be formed from rubber, silicone, polyurethane, or the like. When the mobile phone 10 is mounted on a horizontal mounting surface, such as a desk, with the lateral side 20*a* downwards, i.e. when stood horizontally, the mobile phone 10 is supported at two points on the mounting surface by the piezoelectric vibrator 60 and the elastic member 70. The arrangement of the piezoelectric vibrator 60 and the elastic member 70 is described in detail below.

Figure 2:
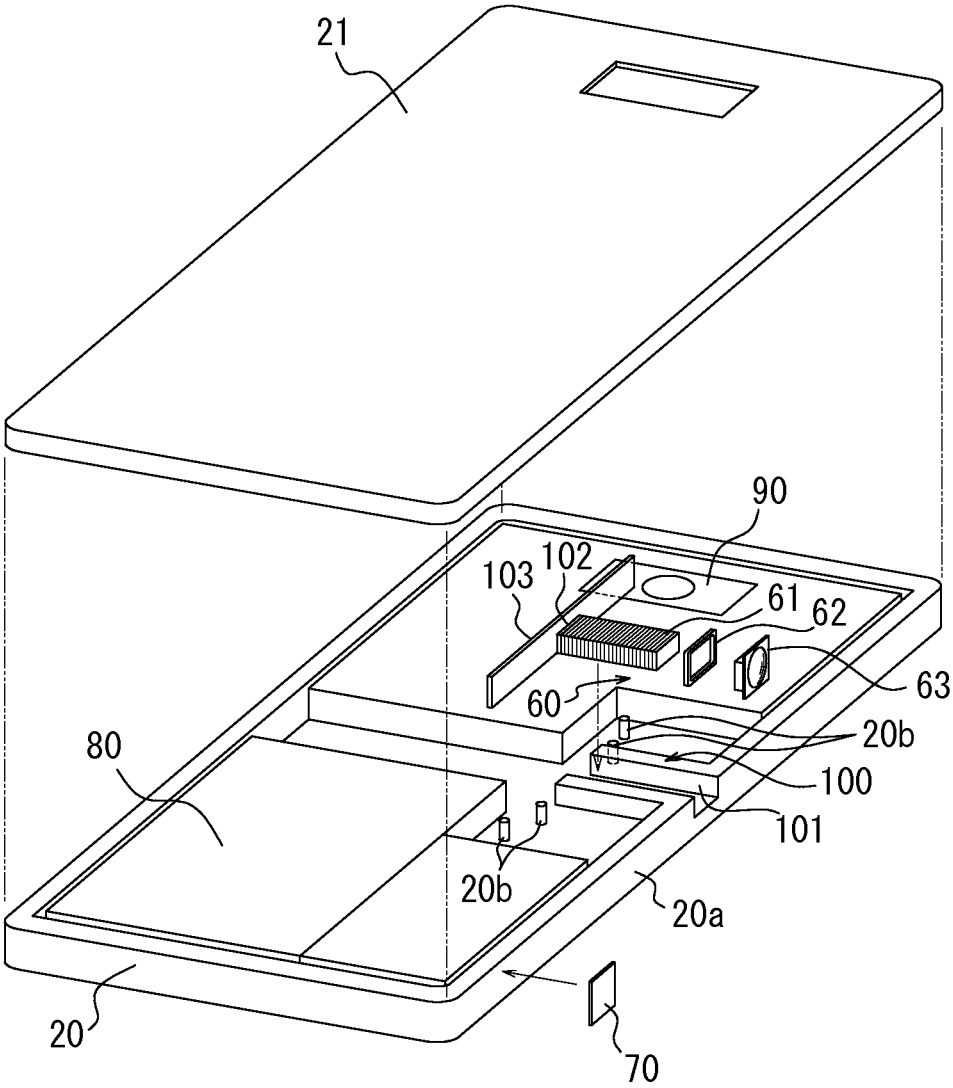
FIG. 2 is an exploded perspective view schematically illustrating the main parts at the back side of the mobile phone in FIG. 1.

FIG. 2 is an exploded perspective view schematically illustrating the main parts at the back side of the mobile phone 10 in FIG. 1. A battery pack 80, a camera unit 90, and the like are installed at the back side of the housing 20. At the back side of the housing 20, the mobile phone 10 includes a holding unit 100 that houses and holds the piezoelectric vibrator 60. The holding unit 100 includes a slit 101 with a uniform width and a plate spring 103 that is shaped as an elongated rectangle and forms an elastic support member. The slit 101 extends along the transverse direction of the housing 20, with one end opening inside the housing 20 and the other end opening to the lateral side 20*a*.

The piezoelectric vibrator 60 includes a piezoelectric element 61, an O-ring 62, and an insulating cap 63 that is a cover member. The piezoelectric element 61 is formed by elements that, upon application of an electric signal (voltage), either expand and contract or bend in accordance with the electromechanical coupling coefficient of their constituent material. Ceramic or crystal elements, for example, may be used. The piezoelectric element 61 may be a unimorph, bimorph, or laminated piezoelectric element. Examples of a laminated piezoelectric element include a laminated bimorph element with layers of bimorph (for example, 8 to 40 layers) and a stack-type element configured with a laminated structure formed by a plurality of dielectric layers composed of, for example, lead zirconate titanate (PZT) and electrode layers disposed between the dielectric layers. Unimorph expands and contracts upon the application of an electric signal, bimorph bends upon the application of an electric signal, and a stack-type laminated piezoelectric element expands and contracts along the lamination direction upon the application of an electric signal.

In the present embodiment, the piezoelectric element 61 is a stack-type laminated piezoelectric element. For example as illustrated in the expanded cross-sectional view and plan view in FIG. 3A and FIG. 3B, the laminated piezoelectric element 61 is configured with alternately layered dielectric materials 61*a*, for example formed from ceramic such as PZT or the like, and internal electrodes 61*b* with a cross-sectional comb shape. Internal electrodes 61*b* connecting to a first lateral electrode 61*c* and internal electrodes 61*b* connecting to a second lateral electrode 61*d* are alternately layered and respectively connect to the first lateral electrode 61*c* and the second lateral electrode 61*d* electrically.

Figure 3A:
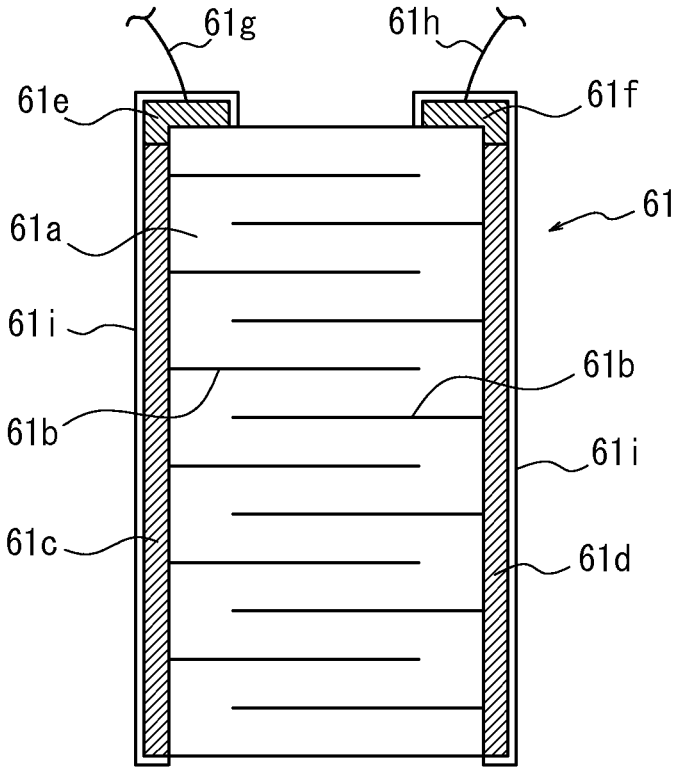
FIG. 3A is an enlarged cross-sectional view illustrating the structure of the laminated piezoelectric element in FIG. 2.
Figure 3B:
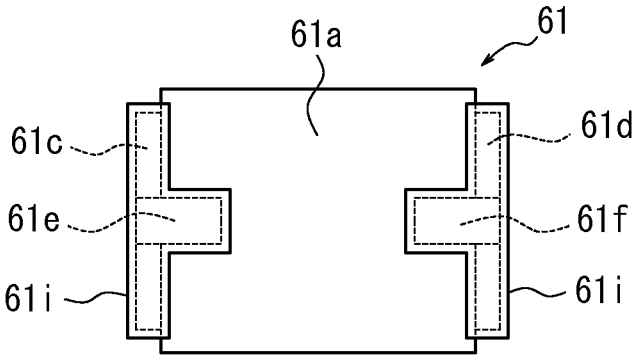
FIG. 3B is an enlarged plan view illustrating the structure of the laminated piezoelectric element in FIG. 2.

The laminated piezoelectric element 61 illustrated in FIG. 3A and FIG. 3B has formed, at one end face, a first lead connector 61*e* electrically connected to the first lateral electrode 61*c* and a second lead connector 61*f* electrically connected to the second lateral electrode 61*d*. A first lead wire 61*g* and a second lead wire 61*h* respectively connect to the first lead connector 61*e* and the second lead connector 61*f*. The first lateral electrode 61*c*, second lateral electrode 61*d*, first lead connector 61*e*, and second lead connector 61*f* are covered by an insulating layer 61*i* in a state with the first lead wire 61*g* and the second lead wire 61*h* respectively connected to the first lead connector 61*e* and the second lead connector 61*f*.

The laminated piezoelectric element 61 has a length of, for example, 5 mm to 120 mm in the lamination direction. The cross-sectional shape of the laminated piezoelectric element 61 in a direction perpendicular to the lamination direction may, for example, be an approximate square between 2 mm square and 10 mm square or may be any shape other than a square. Note that the number of layers and the cross-sectional area of the laminated piezoelectric element 61 are determined appropriately in accordance with the weight of the mobile phone 10 (in the case of a portable electronic device, for example 80 g to 800 g) that serves as an anchor, so as to ensure sufficient pressure or quality of the sound emitted from the contact surface, such as a desk, with which the piezoelectric vibrator 60 is in contact.

As described below with reference to FIG. 7, the laminated piezoelectric element 61 is supplied with a sound signal (playback sound signal) from a control unit 130 via a piezoelectric element drive unit 120. In other words, voltage corresponding to a sound signal is applied to the laminated piezoelectric element 61 from the control unit 130 via the piezoelectric element drive unit 120. If the voltage applied from the control unit 130 is AC voltage, negative voltage is applied to the second lateral electrode 61*d* when positive voltage is applied to the first lateral electrode 61*c*. Conversely, positive voltage is applied to the second lateral electrode 61*d* when negative voltage is applied to the first lateral electrode 61*c*. Upon voltage being applied to the first lateral electrode 61*c* and the second lateral electrode 61*d*, polarization occurs in the dielectric materials 61*a*, and the laminated piezoelectric element 61 expands and contracts from the state in which no voltage is applied. The laminated piezoelectric element 61 expands and contracts in a direction substantially matching the lamination direction of the dielectric materials 61*a*. Having the laminated piezoelectric element 61 expand and contract substantially along the lamination direction yields the advantage of good vibration transmission efficiency in the expansion and contraction direction.

Figure 4:
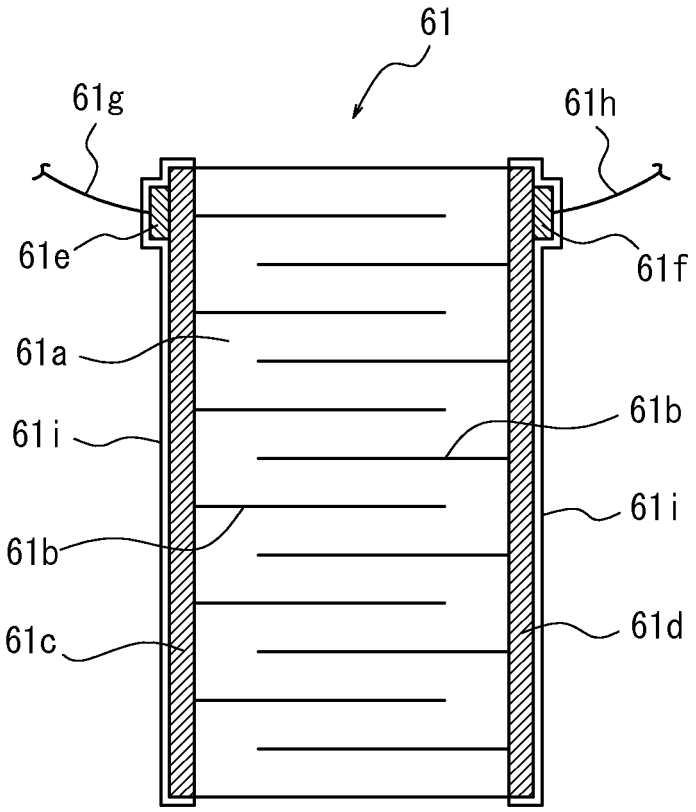
FIG. 4 illustrates a modification to the laminated piezoelectric element.

In FIG. 3A and FIG. 3B, the first lateral electrode 61*c* and the second lateral electrode 61*d* may be through holes that are alternately connected to the internal electrodes 61*b* and respectively connected to the first lead connector 61*e* and second lead connector 61*f*. Furthermore, in FIG. 3A and FIG. 3B, the first lead connector 61*e* and the second lead connector 61*f* may, as illustrated in FIG. 4, be formed on the first lateral electrode 61*c* and the second lateral electrode 61*d* at one edge of the laminated piezoelectric element 61.

Figure 5:
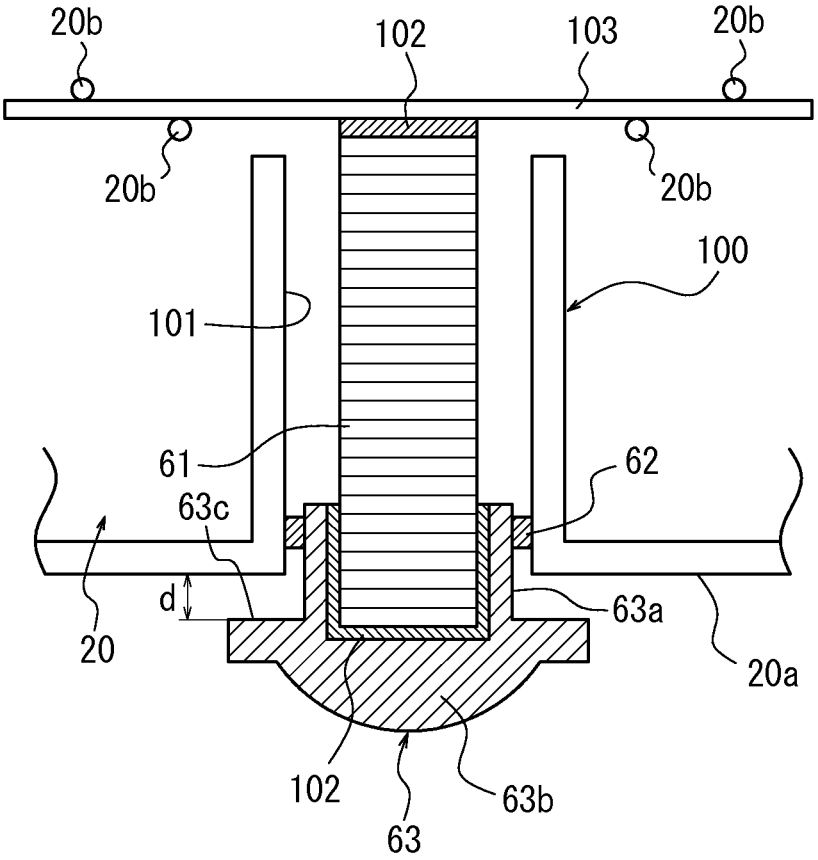
FIG. 5 is a partially enlarged cross-sectional view of the piezoelectric vibrator in FIG. 1.

As illustrated by the partially enlarged cross-sectional view in FIG. 5, the laminated piezoelectric element 61 extends along the slit 101. The end face of the laminated piezoelectric element 61 that includes the first lead connector 61*e* and the second lead connector 61*f* illustrated in FIG. 3 protrudes from the opening of the slit 101 inside the housing 20 and is fixed by adhesive 102 substantially at the center in the longitudinal direction of the plate spring 103. The cap 63 is inserted onto the other end face of the laminated piezoelectric element 61 and fixed by adhesive 102.

The plate spring 103 is supported inside the housing 20 in a manner allowing for flexing deformation in the thickness direction. In the present embodiment, the edges of the plate spring 103 in the longitudinal direction are each sandwiched in the thickness direction between a pair of projecting supports 20*b* that are provided in the housing 20 separated from each other in the longitudinal direction. The plate spring 103 is thus supported in a manner allowing for flexing deformation in the thickness direction.

The cap 63 is formed from a material, such as hard plastic or the like, that can reliably transmit the expanding and contracting vibration of the laminated piezoelectric element 61 to the mounting surface (contact surface), such as a desk. In order to suppress scratching of the mounting surface, the cap 63 may be made from a relatively soft plastic instead of hard plastic. With the cap 63 mounted on the laminated piezoelectric element 61, an entering portion 63*a* located in the slit 101 and a protrusion 63*b* protruding from the housing 20 are formed in the cap 63. The O-ring 62 is disposed on the outer circumference of the entering portion 63*a* located in the slit 101. The O-ring 62 may, for example, be formed from silicone rubber. The O-ring 62 is for movably holding the laminated piezoelectric element 61 and also makes it difficult for moisture or dust to enter into the slit 101. The tip of the protrusion 63*b* is formed in a hemispherical shape. The tip of the protrusion 63*b* is not limited to being hemispherical, however, and may be any shape that reliably has point contact or surface contact with the mounting surface (contact surface), such as a desk, and can transmit the expanding and contracting vibration of the laminated piezoelectric element 61 to the mounting surface (contact surface). In FIG. 5, the space between the O-ring 62 and the portion of the laminated piezoelectric element 61 adhered to the slit 101 may be filled with gel or the like to increase the effect of moisture protection.

In a state in which the piezoelectric vibrator 60 is mounted in the holding unit 100 and the battery lid 21 is mounted on the housing 20, the protrusion 63*b* of the cap 63 protrudes from the lateral side 20*a* of the housing 20. The protrusion 63*b* of the cap 63 has an opposing face 63*c* that is a surface facing the lateral side 20*a* of the housing 20. As illustrated in FIG. 5, in a state in which no voltage is applied to the laminated piezoelectric element 61 so that the laminated piezoelectric element 61 is not expanding or contracting, the opposing face 63*c* is at a distance of d from the lateral side 20*a*.

Figure 6:
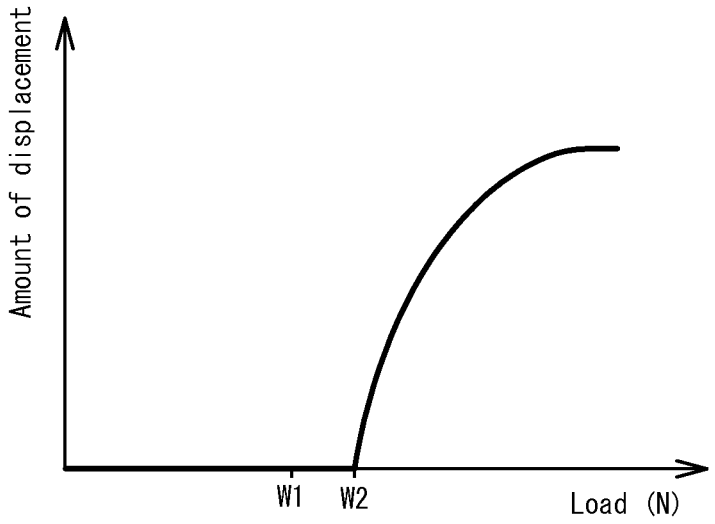
FIG. 6 illustrates an example of the spring characteristics of a plate spring.

FIG. 6 illustrates an example of the spring characteristics of the plate spring 103. When the mobile phone 10 is mounted horizontally with the cap 63 of the piezoelectric vibrator 60 in contact with the contact surface, such as a desk, i.e. while receiving a load w1 of the mobile phone 10, which acts as an anchor, via the piezoelectric vibrator 60, the plate spring 103 does not undergo elastic deformation. In this state, even if the laminated piezoelectric element 61 is displaced due to a sound signal, the plate spring 103 does not undergo elastic deformation. In other words, the plate spring 103 does not undergo elastic deformation under a load received during normal usage yet does undergo elastic deformation under a predetermined load w2 or more, which is greater than the load w1. In FIG. 6, the horizontal axis represents load (N) and the vertical axis represents amount of displacement.

The predetermined load w2 is adjusted appropriately in accordance with factors such as the load w1 of the mobile phone 10 that acts as the anchor, the strength of the laminated piezoelectric element 61 forming the piezoelectric vibrator 60, and the load received due to displacement of the laminated piezoelectric element 61. In the case of the mobile phone 10 weighing, for example, 80 g to 800 g (0.78 N to 7.8 N), the predetermined load w2 may, for example, be 0.94 N to 9.4 N. In this way, when a load equal to or greater than the predetermined load w2 acts on the plate spring 103 via the cap 63 in the lamination direction of the laminated piezoelectric element 61, i.e. in the longitudinal direction, due to the shock of the mobile phone 10 being dropped or the like, the plate spring 103 undergoes elastic deformation, and the piezoelectric vibrator 60 displaces in a direction to withdraw into the housing 20.

Figure 7:
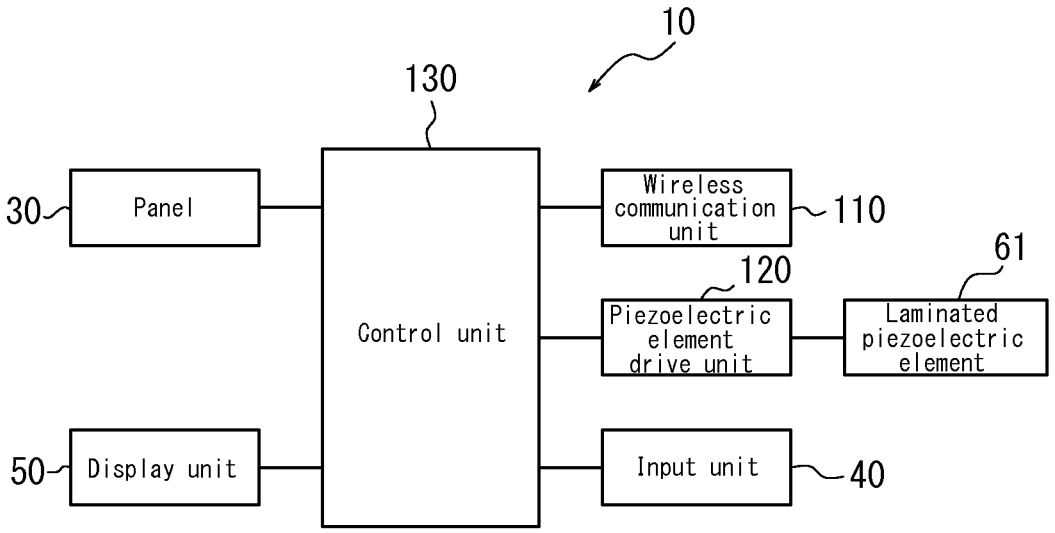
FIG. 7 is a functional block diagram of the main portions of the mobile phone in FIG. 1.

FIG. 7 is a functional block diagram of the main portions of the mobile phone 10 according to the present embodiment. In addition to the above-described panel 30, input unit 40, display unit 50, and laminated piezoelectric element 61, the mobile phone 10 includes a wireless communication unit 110, the piezoelectric element drive unit 120, and the control unit 130. The panel 30, input unit 40, display unit 50, and wireless communication unit 110 connect to the control unit 130. The laminated piezoelectric element 61 connects to the control unit 130 via the piezoelectric element drive unit 120.

The wireless communication unit 110 may have a well-known structure and connects wirelessly to a communication network via a base station or the like. The control unit 130 is a processor that controls overall operations of the mobile phone 10. The control unit 130 applies a playback sound signal (voltage corresponding to a playback sound signal of the other party's voice, a ringtone, music including songs, or the like) to the laminated piezoelectric element 61 via the piezoelectric element drive unit 120. The playback sound signal may be based on music data stored in internal memory or may be music data stored on an external server or the like and played back over a network.

Figure 8:
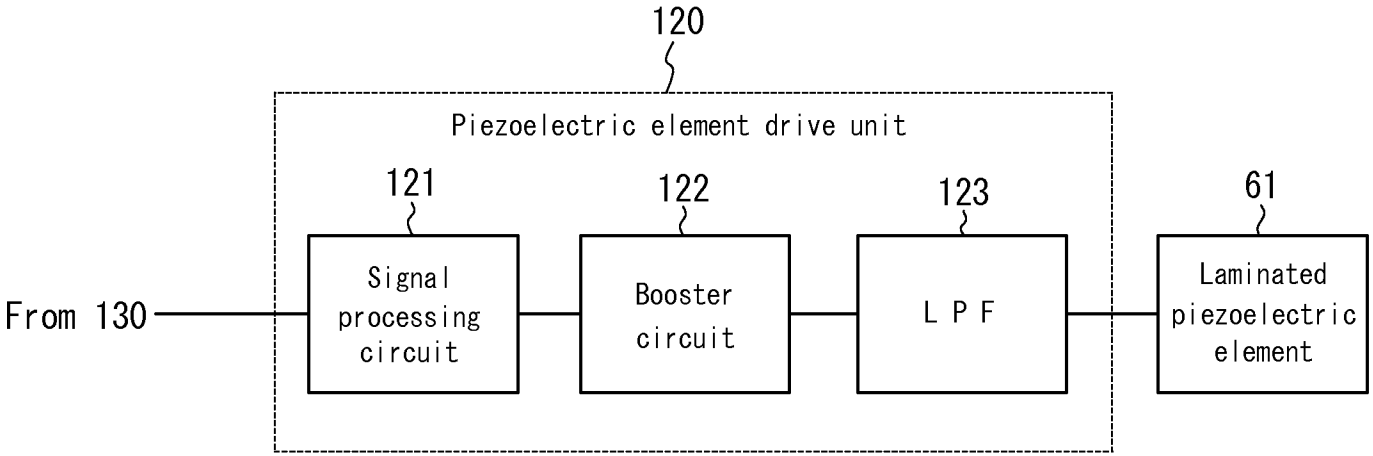
FIG. 8 is a functional block diagram illustrating the structure of an example of the piezoelectric element drive unit in FIG. 6.

For example as illustrated in FIG. 8, the piezoelectric element drive unit 120 includes a signal processing circuit 121, a booster circuit 122, and a low pass filter (LPF) 123. The signal processing circuit 121 may be configured using a digital signal processor (DSP) or the like that includes, for example, an equalizer, A/D converter circuit, or the like. The signal processing circuit 121 performs necessary signal processing, such as equalizing, D/A conversion, or the like on a digital signal from the control unit 130 to generate an analog playback sound signal, outputting the analog playback sound signal to the booster circuit 122. The functions of the signal processing circuit 121 may be internal to the control unit 130.

The booster circuit 122 boosts the voltage of the input analog playback sound signal and applies the result to the laminated piezoelectric element 61 via the LPF 123. The maximum voltage of the playback sound signal applied to the laminated piezoelectric element 61 may, for example, be from 10 Vpp to 50 Vpp, yet the voltage is not limited to this range and may be adjusted appropriately in accordance with the weight of the mobile phone 10 and the performance of the laminated piezoelectric element 61. For the playback sound signal applied to the laminated piezoelectric element 61, direct current may be biased, and the maximum voltage may be set centered on the bias voltage.

Figure 9:
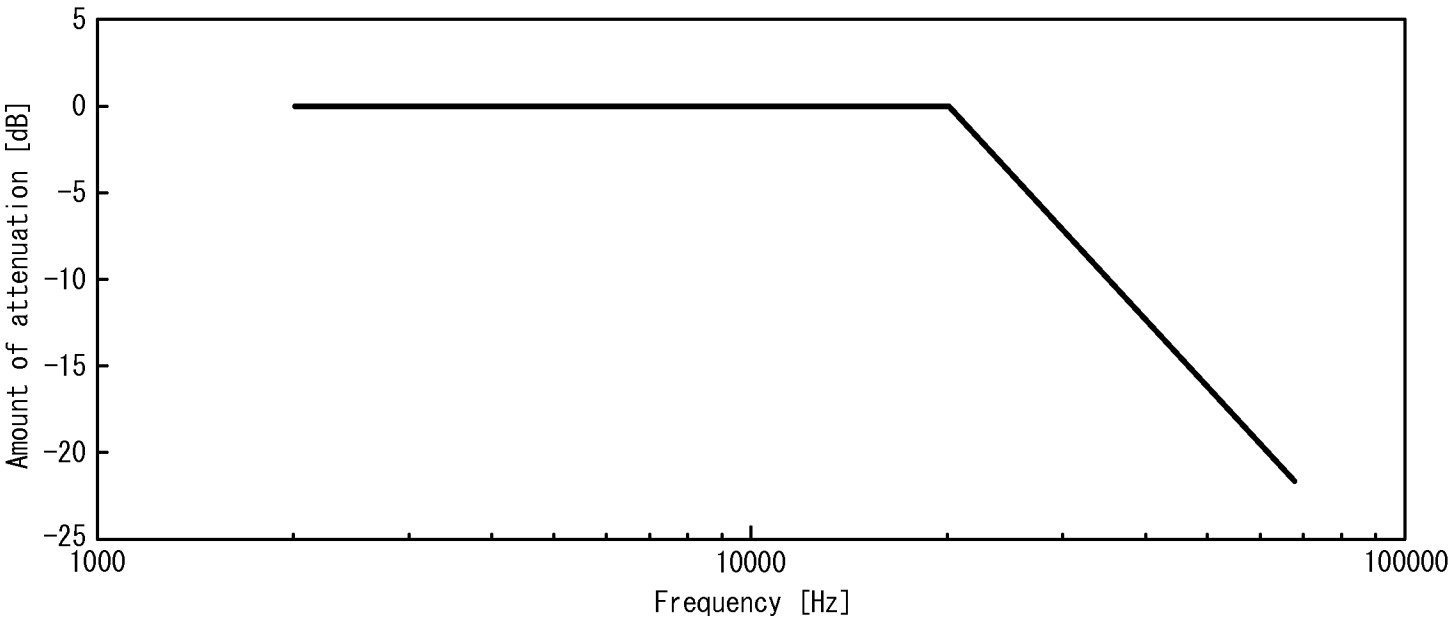
FIG. 9 illustrates an example of the frequency characteristic of the LPF in FIG. 7.

For piezoelectric elements in general, not just the laminated piezoelectric element 61, power loss increases as the frequency becomes higher. Therefore, the LPF 123 is set to have a frequency characteristic that attenuates or cuts at least a portion of a frequency component of approximately 10 kHz to 50 kHz or more, or to have a frequency characteristic such that the attenuation rate increases gradually or stepwise. As an example, FIG. 9 illustrates the frequency characteristic of the LPF 123 when the cutoff frequency is approximately 20 kHz. Thus attenuating or cutting the high-frequency component can suppress power consumption and can also suppress heat generation in the laminated piezoelectric element 61.

Figure 10:
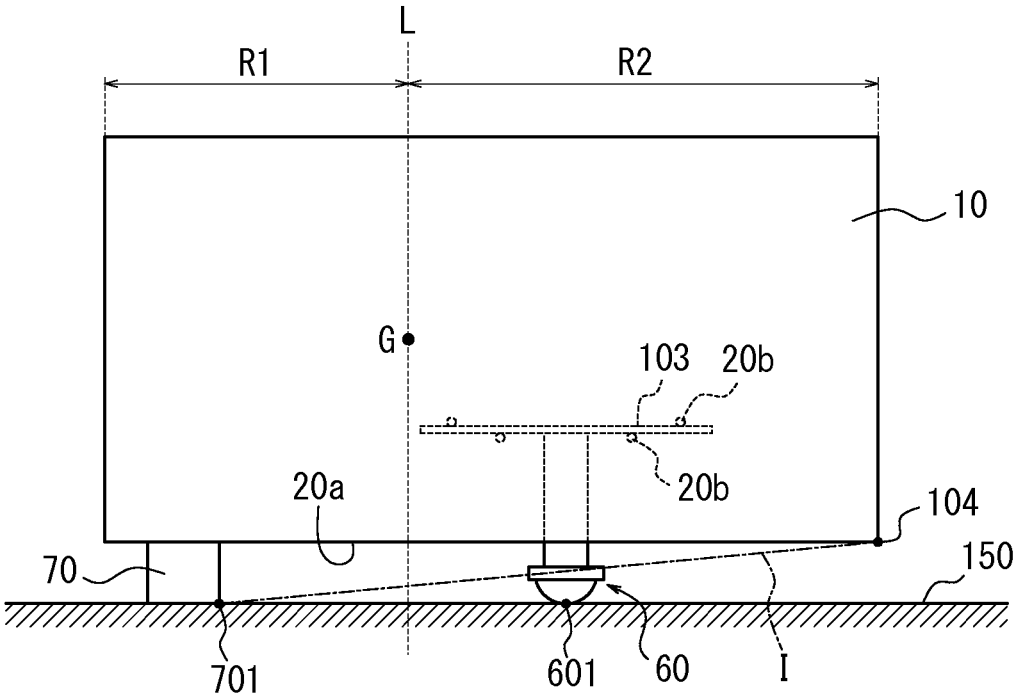
FIG. 10 illustrates the arrangement of the piezoelectric vibrator and the elastic member in the sound generator in FIG. 1.

Next, with reference to FIG. 10, the arrangement of the piezoelectric vibrator 60 and the elastic member 70 is described. FIG. 10 illustrates a state in which the mobile phone 10 is mounted on a horizontal mounting surface 150, such as a desk, with the lateral side 20*a* downwards. The desk is an example of a contacted member, and the mounting surface 150 is an example of a contact surface (mounting surface) that the sound generator contacts. As illustrated in FIG. 10, the mobile phone 10 is supported at two points on the mounting surface 150 by the piezoelectric vibrator 60 and the elastic member 70. Point G is the center of gravity of the mobile phone 10. In other words, the point G is the center of gravity of the anchor in the sound generator.

In FIG. 10, the elastic member 70 has a lowermost edge 701. The lowermost edge 701 is, within the elastic member 70, the location that abuts the horizontal mounting surface 150, such as a desk, when the mobile phone 10 is mounted on the mounting surface 150 with the lateral side 20*a* downwards.

The piezoelectric vibrator 60 has a lowermost edge 601. The lowermost edge 601 is, within the piezoelectric vibrator 60, the location that abuts the horizontal mounting surface 150, such as a desk, when the mobile phone 10 is mounted on the mounting surface 150 with the lateral side 20*a* downwards. The lowermost edge 601 is, for example, the tip of the cap 63.

The mobile phone 10 has a lowermost edge 104. The lowermost edge 104 is, within the mobile phone 10, the location that would abut the horizontal mounting surface 150, such as a desk, when the mobile phone 10 is mounted on the mounting surface 150 with the lateral side 20*a* downwards if the piezoelectric vibrator 60 did not exist. A non-limiting example of the lowermost edge 104 of the mobile phone 10 is a corner of the housing 20. When a protrusion protrudes from the lateral side 20*a*, this protrusion may be the lowermost edge 104 of the mobile phone 10. The protrusion may, for example, be a side key, a connector cap, or the like.

In FIG. 10, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the lateral side 20*a* downwards. An alternate long and short dash line I is a line (virtual line) that connects the lowermost edge 701 of the elastic member 70 and the lowermost edge 104 of the mobile phone 10 assuming the piezoelectric vibrator 60 does not exist.

In FIG. 10, the region R1 is a region at one side of the mobile phone 10, separated by the dashed line L. The region R2 is a region at the other side of the mobile phone 10, separated by the dashed line L. The elastic member 70 is provided on the lateral side 20*a* in the region R1. The piezoelectric vibrator 60 is provided on the lateral side 20*a* in the region R2.

In the region R2 of the lateral side 20*a*, the piezoelectric vibrator 60 is preferably provided at a position as close as possible to the dashed line L. The load on the piezoelectric vibrator 60 thus increases as compared to when the piezoelectric vibrator 60 is provided at a position distant from the dashed line L on the lateral side 20*a* in the region R2, thus allowing for the mobile phone 10 to be used effectively as an anchor for the sound generator.

In the region R1 of the lateral side 20*a*, the elastic member 70 is preferably provided at a position as far as possible from the dashed line L. A sufficient distance can thus be ensured between the elastic member 70 and the piezoelectric vibrator 60 even when the piezoelectric vibrator 60 is placed at a position as close as possible to the dashed line L. Hence, the sound generator can be stably mounted on the mounting surface 150.

When the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the mounting surface 150 from the alternate long and short dash line I. In this way, the mounting surface 150 can appropriately be vibrated by the piezoelectric vibrator 60.

When the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the mounting surface 150 from the alternate long and short dash line I. It is thus more difficult for the lowermost edge 104 of the mobile phone 10 to contact the mounting surface 150, which for example depending on the type of paint on the housing 20, makes it more difficult for the paint to peel off. Abnormal noise is also less likely to be emitted between the lowermost edge 104 and the mounting surface 150.

A commercially available stand or the like may be attached to the housing 20, for example, and the mobile phone 10 may be stood on a mounting surface, such as a desk, with the lateral side 20*a* downwards. In this case, the lateral side 20*a* is supported at two points by the piezoelectric vibrator 60 and the elastic member 70, and the mobile phone 10 is further supported by the stand.

Figure 11A:
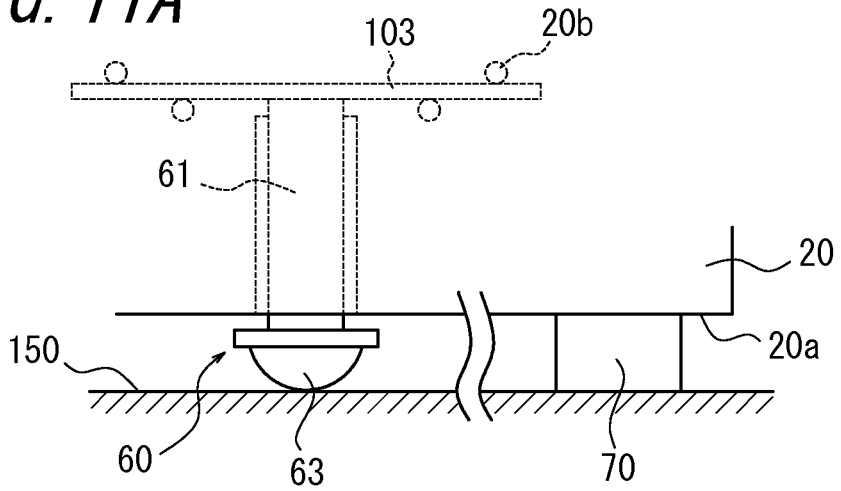
FIG. 11A schematically illustrates operation of the mobile phone in FIG. 1 as a sound generator.
Figure 11B:
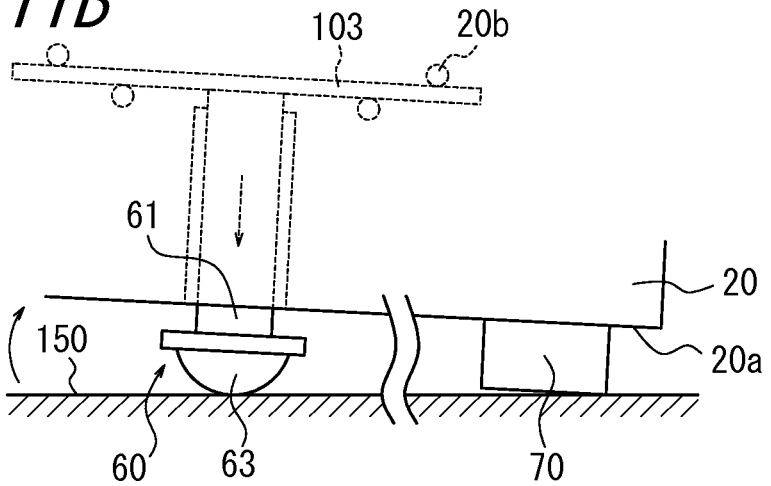
FIG. 11B schematically illustrates operation of the mobile phone in FIG. 1 as a sound generator.
Figure 11C:
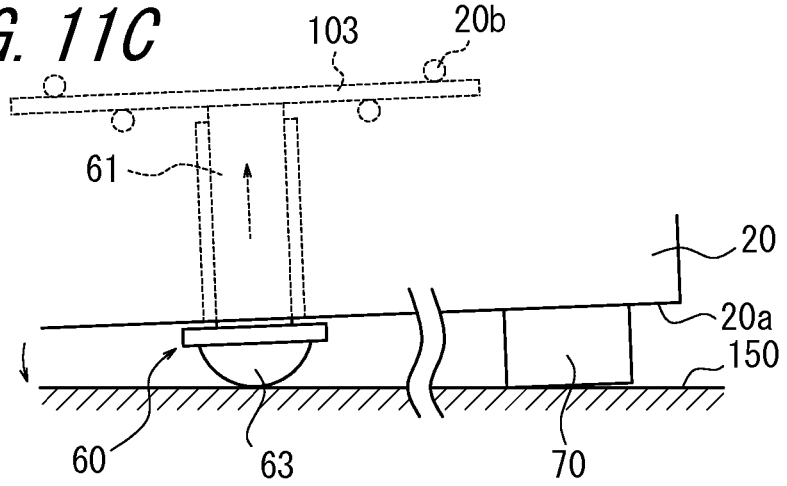
FIG. 11C schematically illustrates operation of the mobile phone in FIG. 1 as a sound generator.

FIGS. 11A, 11B, and 11C schematically illustrate operation of the mobile phone 10 according to the present embodiment as a sound generator. When causing the mobile phone 10 to function as a sound generator, the mobile phone 10 is stood horizontally with the lateral side 20*a* of the housing 20 downwards, so that the cap 63 of the piezoelectric vibrator 60 and the elastic member 70 contact the mounting surface (contact surface) 150, such as a desk, as illustrated in FIG. 11A. In this way, the weight of the mobile phone 10 is provided to the piezoelectric vibrator 60 as a load. In other words, the mobile phone 10 acts as an anchor for the sound generator according to the present embodiment. In the state illustrated in FIG. 11A, no voltage is applied to the laminated piezoelectric element 61, and the laminated piezoelectric element 61 is neither expanding nor contracting.

In this state, when the laminated piezoelectric element 61 of the piezoelectric vibrator 60 is driven by a playback sound signal, the laminated piezoelectric element 61 vibrates by expanding and contracting in accordance with the playback sound signal with the portion of the elastic member 70 contacting the mounting surface (contact surface) 150 acting as a pivot, and without the cap 63 separating from the mounting surface (contact surface) 150, as illustrated in FIGS. 11B and 11C. As long as problems such as the lowermost edge 101 contacting the mounting surface 150 and emitting abnormal noise do not occur, the cap 63 may separate slightly from the mounting surface (contact surface) 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 50 μm, vibration grows large, and the sound generator may wobble.

As described above, when the laminated piezoelectric element 61 is fully expanded, the tip of the cap 63 is preferably located towards the mounting surface 150 from a line (the alternate long and short dash line I in FIG. 10) connecting the lowermost edge 701 of the elastic member 70 and the lowermost edge 104 of the mobile phone 10 assuming the piezoelectric vibrator 60 does not exist. When the laminated piezoelectric element 61 is fully contracted, the tip of the cap 63 is preferably located towards the mounting surface 150 from this virtual line.

The distance d between the lateral side 20*a* and the opposing face 63*c* of the cap 63 illustrated in FIG. 5 is preferably greater than the amount of displacement when the laminated piezoelectric element 61 is fully contracted from a state in which no voltage is applied thereto so that the laminated piezoelectric element 61 is not expanding or contracting. In this way, it is difficult for the lateral side 20*a* of the housing 20 and the cap 63 to contact even when the laminated piezoelectric element 61 is fully contracted (the state in FIG. 11C). As a result, the cap 63 does not easily detach from the piezoelectric element 61.

The location at which the piezoelectric vibrator 60 is disposed on the lateral side 20*a*, the length of the laminated piezoelectric element 61 in the lamination direction, the dimensions of the cap 63, and the like are appropriately determined so as to satisfy the above conditions. In the states illustrated in FIG. 11A, FIG. 11B, and FIG. 11C, the plate spring 103 does not undergo elastic deformation.

According to the sound generator of the present embodiment, a piezoelectric element is used as the source of vibration, hence reducing the number of components as compared to a vibration generating device having a dynamic speaker configuration and achieving a simple structure with few components, thereby allowing for a reduction in size and weight. Furthermore, the stack-type laminated piezoelectric element 61 is used as the piezoelectric element and vibrates by expanding and contracting along the lamination direction due to a playback sound signal. Since this expanding and contracting vibration is transmitted to the contact surface 150, the vibration transmission efficiency with respect to the contact surface 150 in the expansion and contraction direction (deformation direction) is good, and the contact surface 150 can be vibrated efficiently. By standing the mobile phone 10 horizontally so that the cap 63 of the piezoelectric vibrator 60 contacts the contact surface 150, the weight of the mobile phone 10 is applied as a load to the cap 63. Hence, the cap 63 can reliably contact the contact surface 150, and the expanding and contracting vibration of the piezoelectric vibrator 60 can efficiently be transmitted to the contact surface 150. Accordingly, it is possible to cause good sound to be generated.

Figure 12:
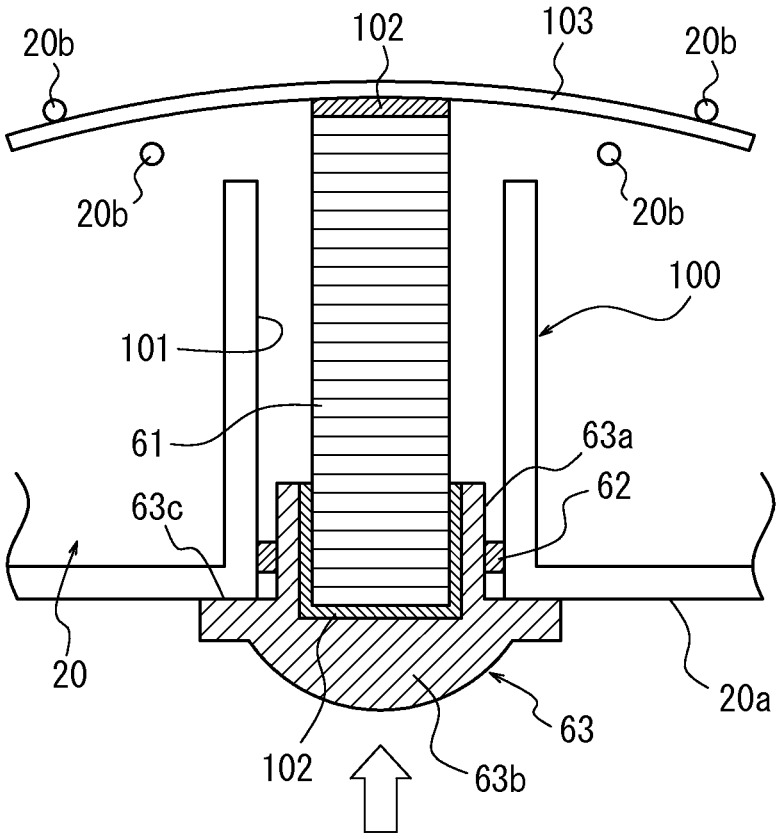
FIG. 12 is a partially enlarged cross-sectional view illustrating behavior due to a shock to the piezoelectric vibrator.

Furthermore, the plate spring 103 to which the laminated piezoelectric element 61 is fixed is configured not to undergo elastic deformation when the load received via the piezoelectric vibrator 60 is a load received during normal usage, which includes the load w1 of the mobile phone 10 that acts as an anchor. The plate spring 103 is also configured to undergo elastic deformation when the load is at least a predetermined load w2 that is greater than the load w1. Accordingly, when an undesired load of at least the predetermined load w2 acts on the plate spring 103 via the piezoelectric vibrator 60 due to the shock of the mobile phone 10 being dropped or the like, the piezoelectric vibrator 60 displaces in a direction to withdraw into the housing 20. In this way, for example as illustrated in the partially enlarged cross-sectional view in FIG. 12, in the piezoelectric vibrator 60, the opposing face 63*c* of the cap 63 abuts against the lateral side 20*a* of the housing 20, and damage to the laminated piezoelectric element 61 due to application of an undesired load to the piezoelectric vibrator 60 is effectively prevented. Moreover, during regular use as well, since the laminated piezoelectric element 61 contacts the contact surface 150 with the cap 63 therebetween, damage to the laminated piezoelectric element 61 during regular use can be prevented. Accordingly, the piezoelectric vibrator 60 can be stably used over an extended period of time.

The sound generator according to the present embodiment can mainly transmit vibration of the laminated piezoelectric element 61 directly to a contact surface (mounting surface) 150. Therefore, unlike when transmitting vibration of a laminated piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a piezoelectric element until the other elastic body returns to a state in which deformation is again possible.

Embodiment 2

Figure 13:
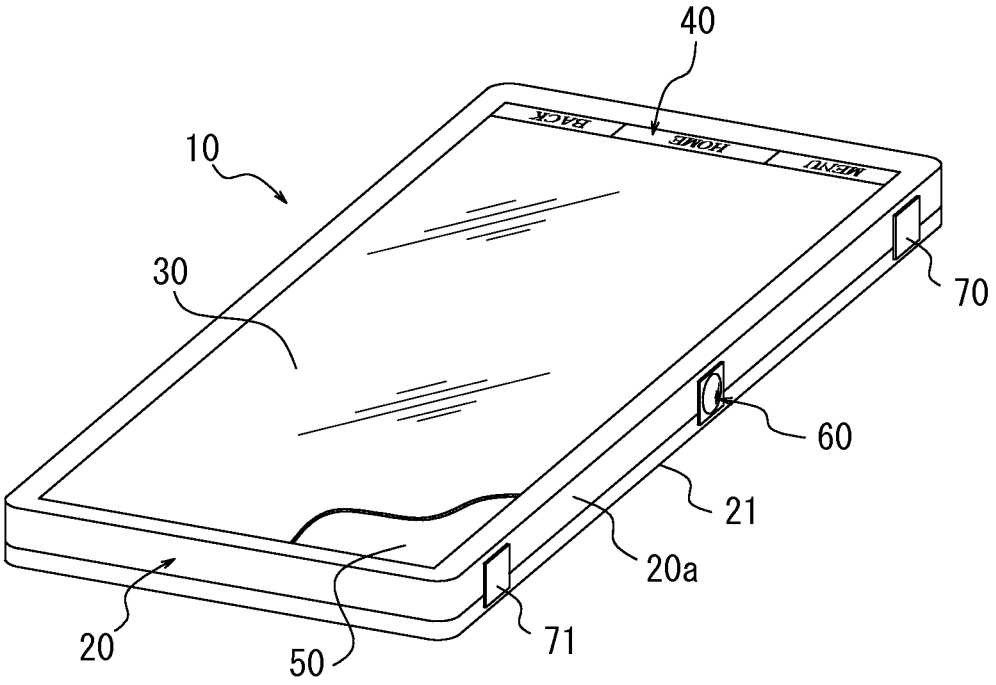
FIG. 13 is an external perspective view of a sound generator according to another embodiment of the present invention.

FIG. 13 is an external perspective view of a sound generator according to Embodiment 2 of the present invention. The sound generator according to the present embodiment has the structure of the mobile phone 10 described in Embodiment 1 with the addition of an elastic member 71 at the opposite edge, with the piezoelectric vibrator 60 therebetween, from the edge where the elastic member 70 is provided on the lateral side 20*a* of the housing 20. The following describes the differences from Embodiment 1, omitting a description of common features.

Like the elastic member 70, the elastic member 71 is sheet-like. Like the elastic member 70, the elastic member 71 may, for example, be formed from rubber, silicone, polyurethane, or the like.

Figure 14:
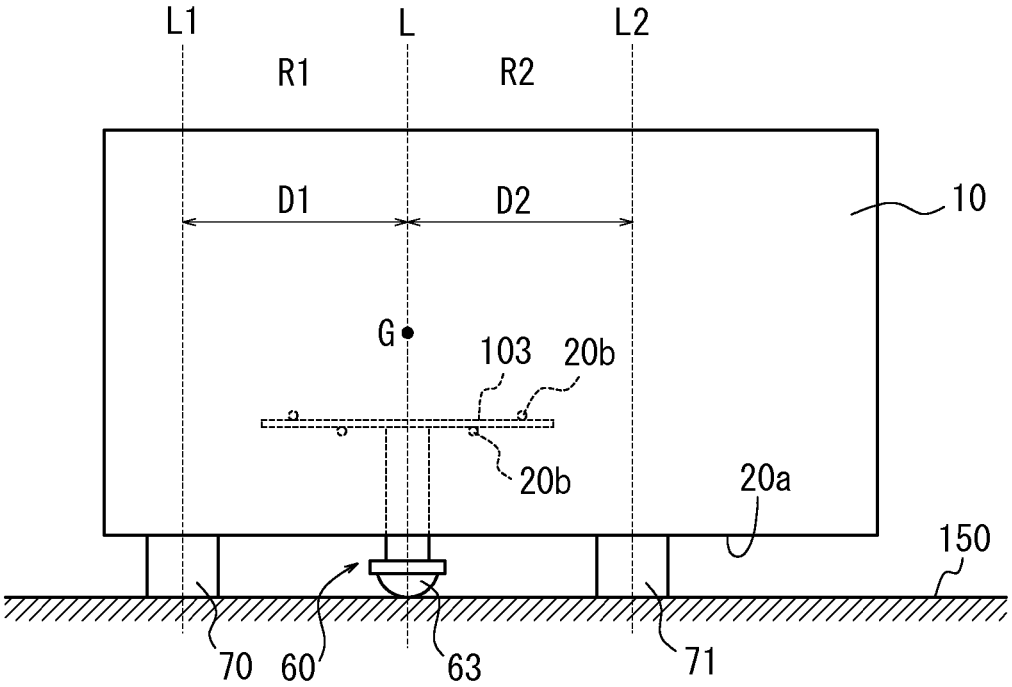
FIG. 14 illustrates the arrangement relationship between the piezoelectric vibrator and the elastic member in the sound generator in FIG. 13.

Next, with reference to FIG. 14, the arrangement relationship between the piezoelectric vibrator 60, the elastic member 70, and the elastic member 71 is described. Like FIG. 10, FIG. 14 illustrates a state in which the mobile phone 10 is mounted on a horizontal mounting surface 150, such as a desk, with the lateral side 20*a* downwards. As illustrated in FIG. 14, the mobile phone 10 is supported at three points on the mounting surface 150 by the piezoelectric vibrator 60, the elastic member 70, and the elastic member 71. Point G is the center of gravity of the mobile phone 10. In other words, the point G is the center of gravity of the anchor in the sound generator.

In FIG. 14, as in FIG. 10, a dashed line L is a line (virtual line) that traverses the center of gravity G of the mobile phone 10 and is perpendicular to the horizontal mounting surface 150, such as a desk, when the mobile phone 10 is mounted on the mounting surface 150 with the lateral side 20*a* downwards. A dashed line L1 is a line (virtual line) that traverses the elastic member 70 and is perpendicular to the mounting surface. A dashed line L2 is a line (virtual line) that traverses the elastic member 71 and is perpendicular to the mounting surface. The dashed line L1 is separated from the dashed line L in the horizontal direction by a distance of D1. The dashed line L2 is separated from the dashed line L in the horizontal direction by a distance of D2.

In FIG. 14, the region R1 is a region at one side of the mobile phone 10, separated by the dashed line L. The region R2 is a region at the other side of the mobile phone 10, separated by the dashed line L. The elastic member 70 is provided on the lateral side 20*a* in the region R1. The elastic member 70 is provided on the lateral side 20*a* at a distance of D1 in the horizontal direction from the piezoelectric vibrator 60. The elastic member 71 is provided on the lateral side 20*a* in the region R2. The elastic member 71 is provided on the lateral side 20*a* at a distance of D2 in the horizontal direction from the piezoelectric vibrator 60.

The piezoelectric vibrator 60 is provided on the lateral side 20*a* along the dashed line L. In other words, when the mobile phone 10 is mounted on the horizontal mounting surface 150, such as a desk, with the lateral side 20*a* downwards, the piezoelectric vibrator 60 is located along a line that traverses the center of gravity G of the mobile phone 10 and is perpendicular to the mounting surface 150. In this way, the weight of the mobile phone 10 acting as an anchor can be applied as a load to the piezoelectric vibrator 60, and the expanding and contracting vibration of the piezoelectric vibrator 60 can efficiently be transmitted to the mounting surface (contact surface) 150.

When D1=D2, i.e. when the elastic member 70 and the elastic member 71 are provided at symmetrical positions in the horizontal direction with the piezoelectric vibrator 60 therebetween, the sound generator can be mounted stably on the mounting surface 150.

When the laminated piezoelectric element 61 is driven by a playback sound signal, the piezoelectric vibrator 60 vibrates by expanding and contracting in accordance with the playback sound signal, without the cap 63 separating from the mounting surface (contact surface) 150. As long as problems such as the lowermost edge of the elastic member 70 and the elastic member 71 contacting the mounting surface 150 and emitting abnormal noise do not occur, the lowermost edge of the elastic member 70 and the elastic member 71 may separate slightly from the mounting surface 150 in response to the expanding and contracting vibration of the piezoelectric vibrator 60.

When the mobile phone 10 is mounted on the horizontal mounting surface 150, such as a desk, with the lateral side 20*a* downwards, the elastic member 70 and the elastic member 71 undergo elastic deformation due to application of the weight of the mobile phone 10 as a load. In other words, under the weight of the mobile phone 10, the elastic member 70 and the elastic member 71 contract in a direction perpendicular to the mounting surface 150. In a state in which no voltage is applied to the laminated piezoelectric element 61 so that the laminated piezoelectric element 61 is not expanding or contracting, the amount of elastic deformation of the elastic member 70 and the elastic member 71 is preferably greater than the amount of displacement of the laminated piezoelectric element 61 when fully expanded from a state in which no voltage is applied thereto so that the laminated piezoelectric element 61 is not expanding or contracting. It is thus more difficult for the elastic member 70 and the elastic member 71 to separate from the mounting surface 150 when the laminated piezoelectric element 61 is fully expanded, allowing for the sound generator to be mounted stably on the mounting surface 150. The same effects as in Embodiment 1 are obtained in the present embodiment as well.

Figure 15A:
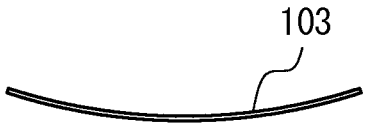
FIG. 15A illustrates a modification to the plate spring.
Figure 15B:
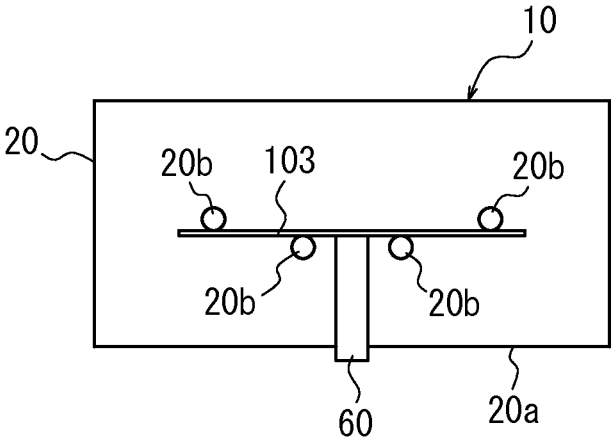
FIG. 15B illustrates a pretension example using the plate spring in FIG. 15A.
Figure 16A:
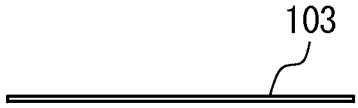
FIG. 16A illustrates a plate spring.
Figure 16B:
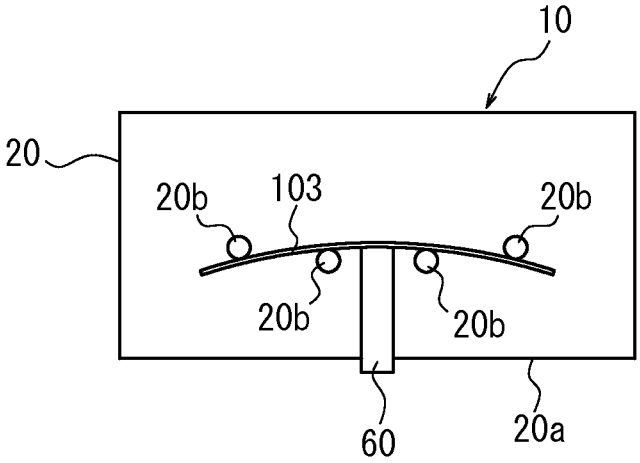
FIG. 16B illustrates a pretension example using the plate spring in FIG. 16A.

The present invention is not limited to Embodiments 1 and 2 above, but rather a variety of modifications and changes are possible. For example, the plate spring 103 may be installed in a state with pretension applied thereto. In this case, as the plate spring 103, for example a spring that is bent into an arc shape is used, as illustrated in FIG. 15A. Pretension is applied by deforming the plate spring 103 against the spring force to be flat, as illustrated in FIG. 15B, and the plate spring 103 is then installed into the mobile phone 10 as in the above embodiment. The piezoelectric vibrator 60 is supported in this case at the outside bottom of the concave portion of the arc-shaped plate spring 103 in FIG. 15A. Alternatively, as the plate spring 103, for example a spring that is flat may be used, as illustrated in FIG. 16A. Pretension is applied by deforming the plate spring 103 against the spring force into an arc shape, as illustrated in FIG. 16B, and the plate spring 103 is then installed into the mobile phone 10. In this case, the piezoelectric vibrator 60 is supported at the inside top of the convex portion of the arc-shaped plate spring 103 in FIG. 16B. Note that in FIG. 15B and in FIG. 16B, illustration of the mobile phone 10 and the piezoelectric vibrator 60 is simplified. The elastic support member of the piezoelectric vibrator 60 is not limited to the plate spring 103 and may, for example, be a block-shaped elastic body of rubber or the like, a spring, or other such member.

The entire piezoelectric vibrator 60 may protrude from the housing. In this case, for example a portion of the lateral side of the housing 20 is configured with an elastic support member that does not undergo elastic deformation under the load w1 of the mobile phone 10 that acts as the anchor and that does undergo elastic deformation under the predetermined load w2, which is greater than the load w1. The piezoelectric vibrator 60 is then supported by this elastic support member.

The cap 63 may be omitted from the piezoelectric vibrator 60, so that the end surface of the laminated piezoelectric element 61 contacts the contact surface directly or with a vibration transmission member, formed from an insulating member or the like, therebetween. The piezoelectric element is not limited to the above-described stack-type laminated piezoelectric element. A unimorph, bimorph, or laminated bimorph element may be used.

Furthermore, in FIG. 8, a LPF having the same characteristics as the LPF 123 may be provided between the signal processing circuit 121 and the booster circuit 122. In FIG. 8, the LPF 123 may also be omitted by providing an equalizer of the signal processing circuit 121 or the like with the functions of the LPF 123.

In Embodiments 1 and 2, an example of the piezoelectric vibrator 60 protruding from the lateral side 20*a* of the housing 20 has been described, yet the present invention is not limited in this way. Depending on the dimensions of the housing 20 and the dimensions of the piezoelectric vibrator 60, the piezoelectric vibrator 60 may, for example, protrude from the battery lid 21.

In Embodiments 1 and 2, the contacted member is a desk, and the contact surface is a horizontal mounting surface of the desk, yet the present invention is not limited in this way. The contact surface need not be horizontal. The contact surface may, for example, be a surface of the desk perpendicular to the ground. An example of a contacted member having a surface perpendicular to the ground is a partition for sectioning off space.

In Embodiments 1 and 2, the sound generator is installed in the mobile phone 10, and the mobile phone 10 functions as an anchor, yet the anchor is not limited in this way. For example, a sound generator may be installed in any of a wide variety of electronic devices serving as an anchor, such as a portable music player, a tabletop television, a telephone conferencing system, a notebook computer, a projector, a hanging clock or hanging television, an alarm clock, or a photo frame. The anchor is not limited to an electronic device and may, for example, be a vase, a chair, or the like. Furthermore, the present invention is not limited to a sound generator and may also be configured as a piezoelectric vibrator for a sound generator, the piezoelectric vibrator including a piezoelectric element, or as a sound generation system provided with a sound generator and a contacted member that has a contact surface contacted by the sound generator. These configurations are also to be understood as within the scope of the present invention.

Embodiment 3

Figure 17:
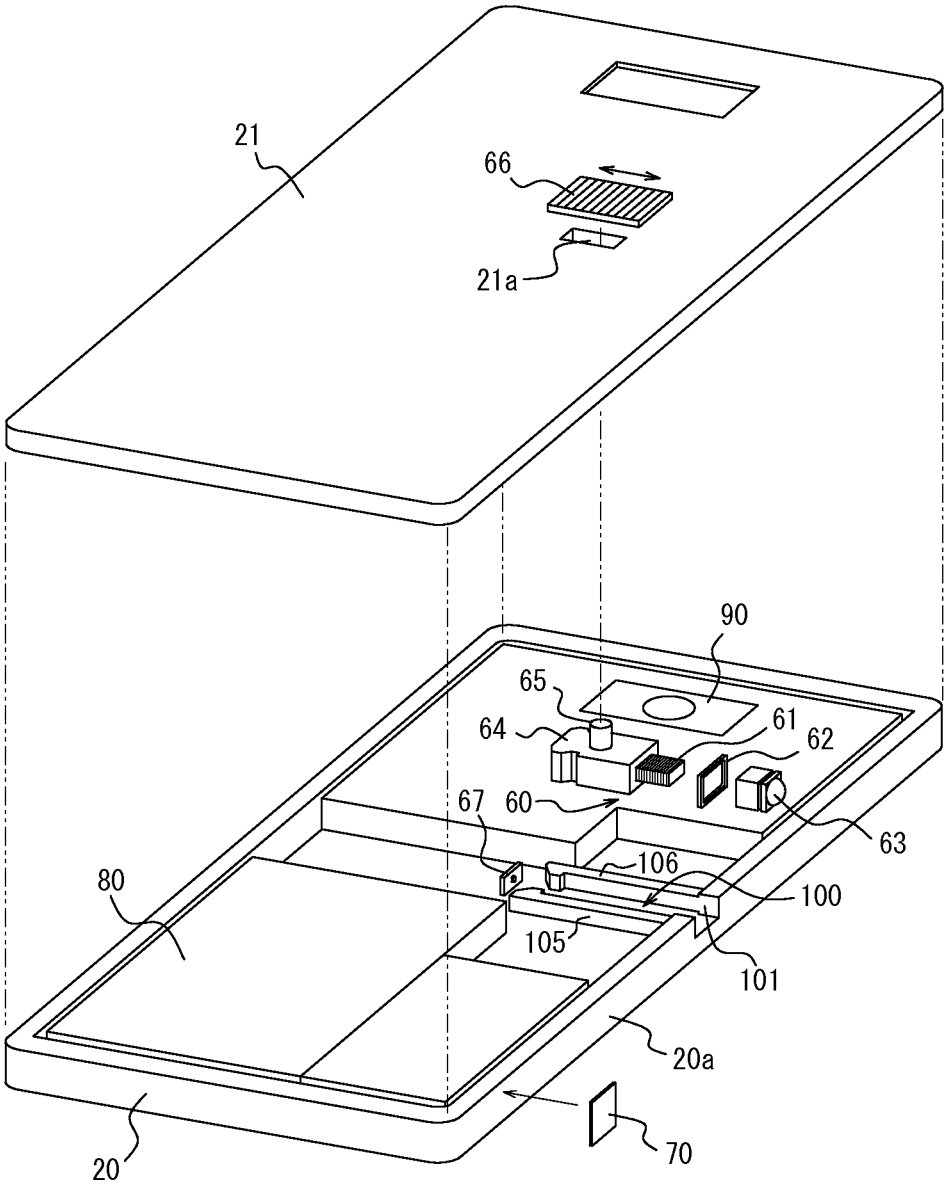
FIG. 17 is an exploded perspective view schematically illustrating the main parts at the back side of a sound generator according to Embodiment 3 of the present invention.

FIG. 17 is an exploded perspective view schematically illustrating the main parts at the back side of a sound generator according to Embodiment 3 of the present invention. The sound generator according to the present embodiment has the structure of the mobile phone 10 described in Embodiment 1, mainly differing in the structure of the piezoelectric vibrator 60 and the holding unit 100. The following describes the differences from Embodiment 1, omitting a description of common features. Note that like FIG. 2, FIG. 17 is an exploded view of the back side of the mobile phone 10.

As described below, the piezoelectric vibrator 60 partially protrudes from the lateral side 20*a*. When the mobile phone 10 is mounted on a horizontal mounting surface, such as a desk, with the lateral side 20*a* downwards, i.e. when stood horizontally, with a portion of the piezoelectric vibrator 60 protruding from the lateral side 20*a*, the mobile phone 10 is supported at two points on the mounting surface by the piezoelectric vibrator 60 and the elastic member 70. The piezoelectric vibrator 60 is held slidably in a slit 101 of the holding unit 100. The slit 101 is formed by a pair of guide members 105 and 106 that are separated in the longitudinal direction of the housing 20 and extend along the transverse direction of the housing 20. One end of the slit 101 opens inside the housing 20, and the other end opens to the lateral side 20*a*. The guide members 105 and 106 forming the slit 101 are displaceable in the longitudinal direction of the housing 20, with respect to the lateral side 20*a*. Trapezoidal projections 105*a* and 106*a* that cooperate with a holder 64 of the piezoelectric vibrator 60, described below, and are part of a lock mechanism are formed on opposing surfaces of the ends of the guide members 105 and 106 located towards the inside of the housing 20.

Figure 18A:
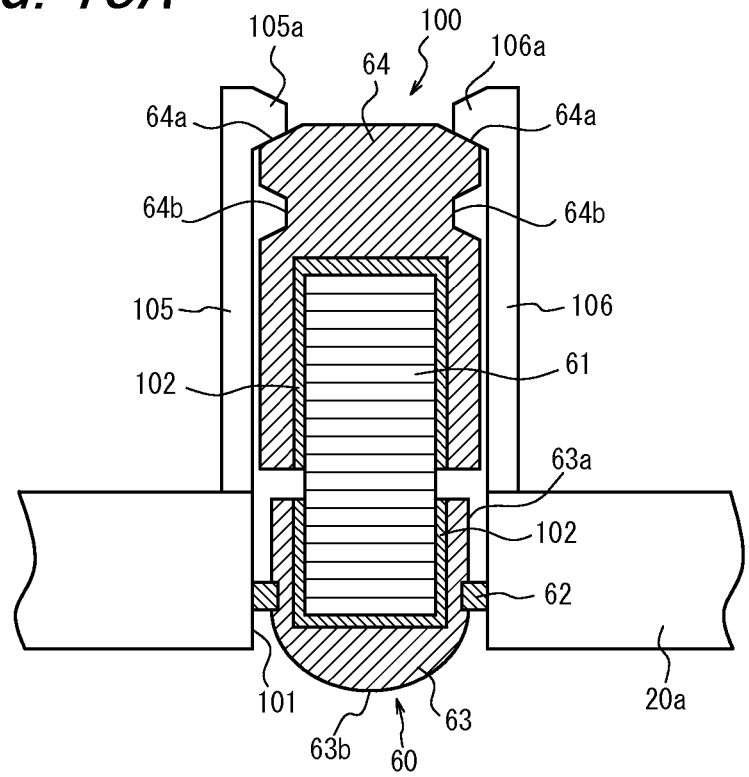
FIG. 18A is a partially enlarged cross-sectional view illustrating a first state of the piezoelectric vibrator in FIG. 17.
Figure 18B:
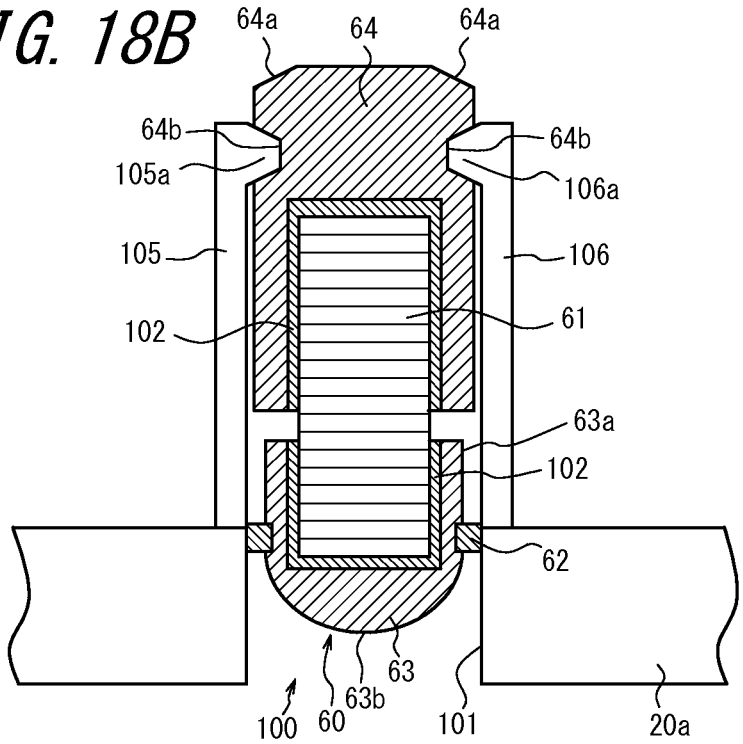
FIG. 18B is a partially enlarged cross-sectional view illustrating a second state of the piezoelectric vibrator in FIG. 17.

As illustrated by the partially enlarged cross-sectional view in FIG. 18A and FIG. 18B, the piezoelectric vibrator 60 extends along the slit 101 and is disposed slidably. The end of the laminated piezoelectric element 61 that includes the first lead connector 61*e* and the second lead connector 61*f* illustrated in FIG. 3 is inserted in the holder 64 and is fixed by adhesive 102. The cap 63 is inserted onto the other end face of the laminated piezoelectric element 61 and fixed by adhesive 102.

The holder 64 is formed from, for example, hard plastic or the like and includes, at the top in FIG. 18A and FIG. 18B, top engaging portions 64*a* and concavities 64*b* that engage selectively with the projections 105*a* and 106*a* of the guide members 105 and 106 and are part of the lock mechanism. As illustrated in FIG. 18A, when the projections 105*a* and 106*a* of the guide members 105 and 106 are engaged with the top engaging portions 64*a* of the holder 64, the lock mechanism maintains a first state in which the cap 63, which is a portion of the piezoelectric vibrator 60, protrudes from the lateral side 20*a* of the housing 20. As illustrated in FIG. 18B, when the projections 105*a* and 106*a* of the guide members 105 and 106 are engaged with the concavities 64*b* of the holder 64, the lock mechanism maintains a second state in which the cap 63 does not protrude from the lateral side 20*a* of the housing 20, i.e. in which the entire piezoelectric vibrator 60 is housed within the housing 20.

The cap 63 includes an entering portion 63*a* that continually faces the wall of the lateral side 20*a* forming the slit 101 and a contacting portion 63*b* that contacts the mounting surface, such as a desk, when the piezoelectric vibrator 60 is in the first state. An O-ring 62 is disposed on the outer circumference of the entering portion 63*a*. The tip of the contacting portion 63*b* is formed in a hemispherical shape. The tip of the contacting portion 63*b* is not limited to being hemispherical, however, and may be any shape that reliably has point contact or surface contact with the mounting surface (contact surface), such as a desk, and can transmit the expanding and contracting vibration of the laminated piezoelectric element 61 to the mounting surface (contact surface).

In order to slide the piezoelectric vibrator 60 for selective transitioning between the first state and the second state, a guide pin 65 is provided in the holder 64 on the surface by the battery lid 21, as illustrated in FIG. 17. A guide hole 21*a* through which the guide pin 65 penetrates is formed in the battery lid 21 extending in the sliding direction of the piezoelectric vibrator 60, i.e. in the direction of the shorter sides of the housing 20. A slide plate 66 is mounted onto the guide pin 65 that projects from the guide hole 21*a*. In this way, by sliding the slide plate 66 in the direction of the shorter sides of the housing 20 (the direction indicated by the arrows), the user can selectively transition the piezoelectric vibrator 60 between the first state illustrated in FIG. 18A and the second state illustrated in FIG. 18B.

Dust and moisture protection treatment is preferably applied to the guide hole 21*a* for the guide pin 65 and the slide plate 66 to be slidable. When the piezoelectric vibrator 60 is in the first state, and the mobile phone 10 is stood horizontally, with the cap 63 of the piezoelectric vibrator 60 contacting the mounting surface, such as a desk, i.e. while the load w1 of the mobile phone 10 acting as an anchor is being applied via the piezoelectric vibrator 60, the lock mechanism can effectively maintain the piezoelectric vibrator 60 in the first state even if the laminated piezoelectric element 61 displaces due to a sound signal. Upon a predetermined load w3 or more, which is greater than the load w1, acting on the cap 63 in the first state, the lock mechanism releases the piezoelectric vibrator 60 from the first state and displaces the piezoelectric vibrator 60 towards the second state.

The predetermined load w3 is adjusted appropriately in accordance with factors such as the load w1 of the mobile phone 10 that acts as the anchor, the strength of the laminated piezoelectric element 61 forming the piezoelectric vibrator 60, and the load received due to displacement of the laminated piezoelectric element 61. In the case of the mobile phone 10 weighing, for example, 80 g to 800 g (0.78 N to 7.8 N), the predetermined load w3 may, for example, be 0.94 N to 9.4 N. In this way, while the piezoelectric vibrator 60 is in the first state, when a load equal to or greater than the predetermined load w3 is applied via the cap 63 in the lamination direction of the laminated piezoelectric element 61, i.e. in the longitudinal direction, due to the shock of the mobile phone 10 being dropped or the like, the piezoelectric vibrator 60 is released from being locked in the first state, and the piezoelectric vibrator 60 displaces from the first state in a direction to withdraw into the housing 20.

As illustrated in FIG. 17, a state detection unit 67 that detects the first state or the second state of the piezoelectric vibrator 60 in coordination with the sliding operation of the piezoelectric vibrator 60 is provided in the housing 20. The state detection unit 67 may, for example, be configured using a tact switch or a photoelectric sensor. The state detection unit 67 may be configured by, for example, providing a fixed contact on a portion of either of the guide members 105 and 106 and providing a moving contact on a portion of the holder 64 in the piezoelectric vibrator 60, the moving contact contacting and separating from the fixed contact respectively in the first state and the second state of the piezoelectric vibrator 60. In FIG. 17, a tact switch is shown as an example of the state detection unit 67. The tact switch is turned ON/OFF by the holder 64 of the piezoelectric vibrator 60 in coordination with the sliding operation of the piezoelectric vibrator 60.

The state detection unit 67 is turned ON or OFF when the piezoelectric vibrator 60 is in the first state and is turned OFF or ON when the piezoelectric vibrator 60 is in the second state. The laminated piezoelectric element 61 is controlled to allow driving in response to a sound signal when the state detection unit 67 for example has detected the first state of the piezoelectric vibrator 60 and not to be driven when the state detection unit 67 has not detected the first state of the piezoelectric vibrator 60.

Figure 19:
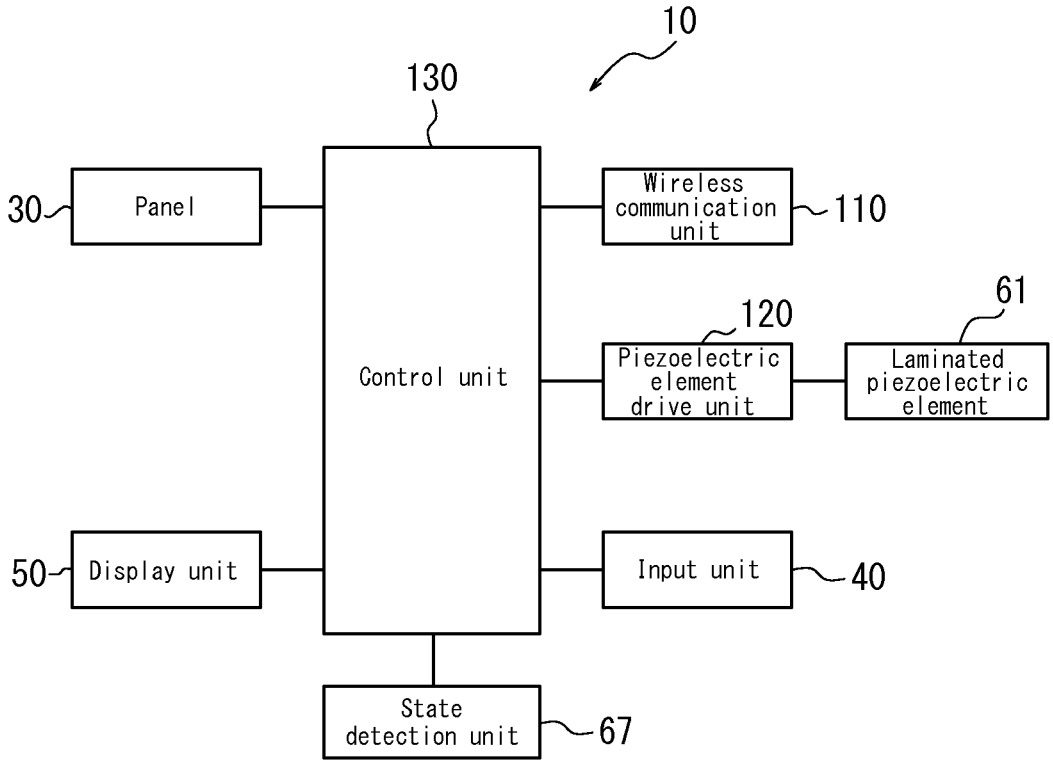
FIG. 19 is a functional block diagram of the main portions of the mobile phone in FIG. 17.

FIG. 19 is a functional block diagram of the main portions of the mobile phone 10 according to the present embodiment. In addition to the structure illustrated in FIG. 7, the mobile phone 10 includes the state detection unit 67. The state detection unit 67 connects to the control unit 130. While the state detection unit 67 has detected the first state of the piezoelectric vibrator 60, the control unit 130 applies a playback sound signal (voltage corresponding to a playback sound signal of the other party's voice, a ringtone, music including songs, or the like) to the laminated piezoelectric element 61 via the piezoelectric element drive unit 120.

Figure 20:
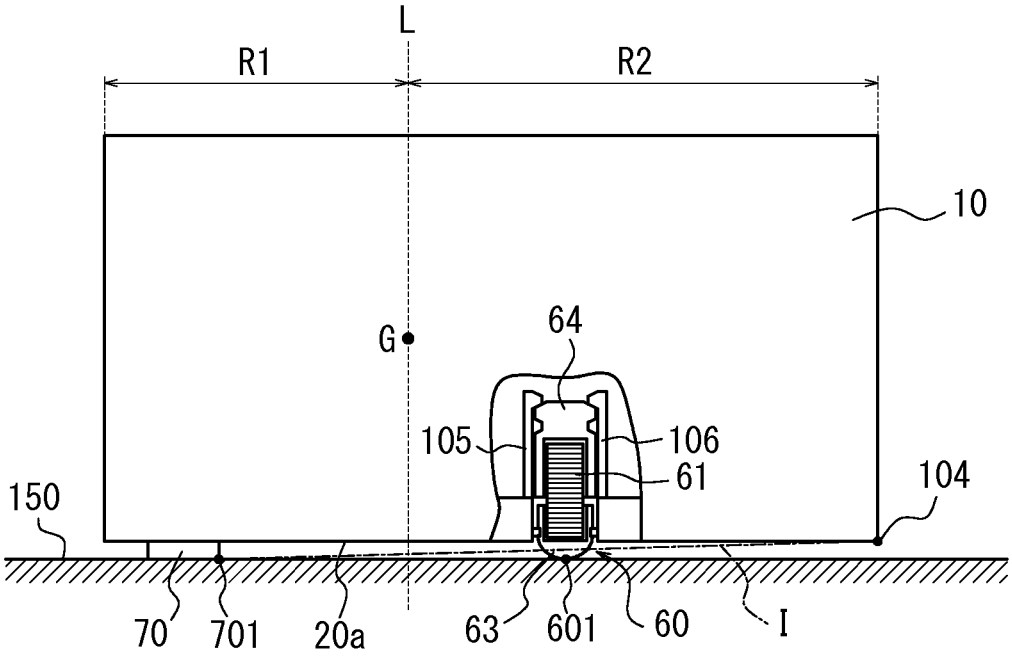
FIG. 20 illustrates the arrangement of the piezoelectric vibrator and the elastic member in the sound generator in FIG. 17.

Next, with reference to FIG. 20, the arrangement of the piezoelectric vibrator 60 and the elastic member 70 is described. FIG. 20 illustrates a state in which the mobile phone 10 is mounted on a horizontal mounting surface 150, such as a desk, with the lateral side 20*a* downwards while the piezoelectric vibrator 60 is in the first state. As illustrated in FIG. 20, when the piezoelectric vibrator 60 is in the first state, the mobile phone 10 is supported at two points on the mounting surface 150 by the lowermost edge 601 of the piezoelectric vibrator 60 and the lowermost edge 701 of the elastic member 70 abutting the mounting surface 150. When the piezoelectric vibrator 60 is in the second state, upon mounting the mobile phone 10 on the mounting surface 150 with the lateral side 20*a* downwards, the lowermost edge 701 of the elastic member 70 and the lowermost edge 104 of the mobile phone 10 abut the mounting surface 150.

In FIG. 20, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully expanded from a state in which no voltage is applied thereto so that the laminated piezoelectric element 61 is not expanding or contracting, or at the time of maximum amplitude of the laminated piezoelectric element 61, the lowermost edge 601 preferably projects towards the mounting surface 150 from the alternate long and short dash line I. In this way, the mounting surface 150 can appropriately be vibrated by the piezoelectric vibrator 60.

Furthermore, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 of the piezoelectric vibrator 60 is preferably located towards the mounting surface 150 from the alternate long and short dash line I. In other words, when the laminated piezoelectric element 61 is fully contracted from a state in which no voltage is applied thereto so that the laminated piezoelectric element 61 is not expanding or contracting, or at the time of minimum amplitude of the laminated piezoelectric element 61, the lowermost edge 601 preferably projects towards the mounting surface 150 from the alternate long and short dash line I. It is thus more difficult for the lowermost edge 104 of the mobile phone 10 to contact the mounting surface 150, which for example depending on the type of paint on the housing 20, makes it more difficult for the paint to peel off. Abnormal noise is also less likely to be emitted between the lowermost edge 104 and the mounting surface 150.

Figure 21A:
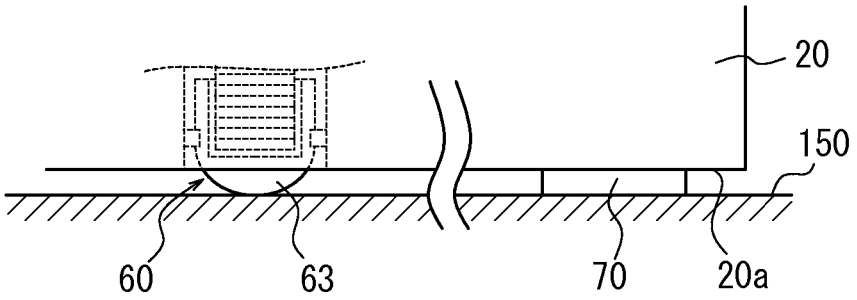
FIG. 21A schematically illustrates operation of the mobile phone in FIG. 17 as a sound generator.
Figure 21B:
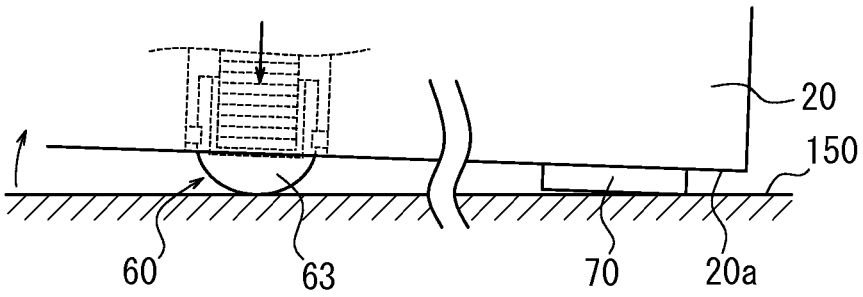
FIG. 21B schematically illustrates operation of the mobile phone in FIG. 17 as a sound generator.
Figure 21C:
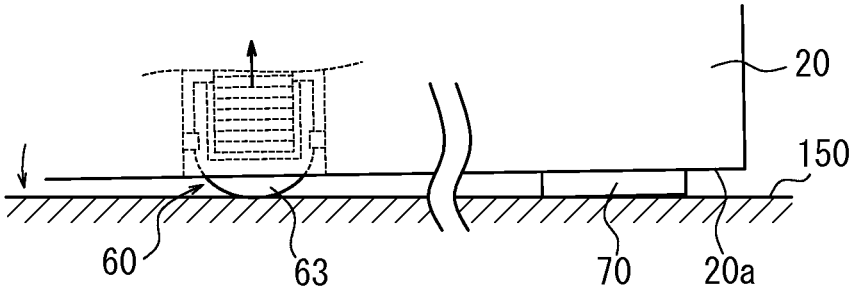
FIG. 21C schematically illustrates operation of the mobile phone in FIG. 17 as a sound generator.

FIGS. 21A, 21B, and 21C schematically illustrate operation of the mobile phone 10 according to the present embodiment as a sound generator. When causing the mobile phone 10 to function as a sound generator, the piezoelectric vibrator 60 is placed in the first state and the mobile phone 10 is stood horizontally with the lateral side 20*a* of the housing 20 downwards, so that the cap 63 of the piezoelectric vibrator 60 and the elastic member 70 contact the mounting surface (contact surface) 150, such as a desk, as illustrated in FIG. 21A. In this way, the weight of the mobile phone 10 is provided to the piezoelectric vibrator 60 as a load. In other words, the mobile phone 10 acts as an anchor for the sound generator according to the present embodiment. In the state illustrated in FIG. 21A, no voltage is applied to the laminated piezoelectric element 61, and the laminated piezoelectric element 61 is neither expanding nor contracting.

In this state, when the laminated piezoelectric element 61 of the piezoelectric vibrator 60 is driven by a playback sound signal, the laminated piezoelectric element 61 vibrates by expanding and contracting in accordance with the playback sound signal with the portion of the elastic member 70 contacting the mounting surface (contact surface) 150 acting as a pivot, and without the cap 63 separating from the mounting surface (contact surface) 150, as illustrated in FIGS. 21B and 21C. As in Embodiment 1, in the present embodiment as well, as long as problems such as the lowermost edge 101 contacting the mounting surface 150 and emitting abnormal noise do not occur, the cap 63 may separate slightly from the mounting surface (contact surface) 150. The difference in length between when the laminated piezoelectric element 61 is fully expanded and fully contracted may, for example, be from 0.05 μm to 50 μm. In this way, the expanding and contracting vibration of the laminated piezoelectric element 61 is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 50 μm, vibration grows large, and the sound generator may wobble.

As described above, when the laminated piezoelectric element 61 is fully expanded, the tip of the cap 63 is preferably located towards the mounting surface 150 from a line (the alternate long and short dash line I in FIG. 20) connecting the lowermost edge 701 of the elastic member 70 and the lowermost edge 104 of the mobile phone 10 when the piezoelectric vibrator 60 is in the first state. When the laminated piezoelectric element 61 is fully contracted, the tip of the cap 63 is preferably located towards the mounting surface 150 from this virtual line.

The location at which the piezoelectric vibrator 60 is disposed on the lateral side 20*a*, the length of the laminated piezoelectric element 61 in the lamination direction, the dimensions of the cap 63, and the like are appropriately determined so as to satisfy the above conditions.

According to the sound generator of the present embodiment, as in Embodiment 1, a piezoelectric element is used as the source of vibration, hence reducing the number of components as compared to a vibration generating device having a dynamic speaker configuration and achieving a simple structure with few components, thereby allowing for a reduction in size and weight. Furthermore, the piezoelectric vibrator 60 can selectively transition between the first state in which a portion thereof protrudes from the housing 20 and the second state in which the piezoelectric vibrator 60 does not protrude from the housing 20. Driving is allowed in response to a sound signal when in the first state and is denied when not in the first state. Hence, usability can be improved, and the appearance of the mobile phone 10 is not marred when the piezoelectric vibrator 60 is not being used (when in the second state).

Furthermore, the stack-type laminated piezoelectric element 61 is used as the piezoelectric element and vibrates by expanding and contracting along the lamination direction due to a playback sound signal when the piezoelectric vibrator 60 is in the first state. Since this expanding and contracting vibration is transmitted to the contact surface 150, the vibration transmission efficiency of the laminated piezoelectric element 61 with respect to the contact surface 150 in the expansion and contraction direction (deformation direction) is good, and the contact surface 150 can be vibrated efficiently. With the piezoelectric vibrator 60 in the first state, upon standing the mobile phone 10 horizontally and contacting the cap 63 of the piezoelectric vibrator 60 to the contact surface 150, the weight of the mobile phone 10 acts as a load on the cap 63. In this way, the cap 63 can reliably contact the contact surface 150, and the expanding and contracting vibration of the piezoelectric vibrator 60 can efficiently be transmitted to the contact surface 150. Accordingly, it is possible to cause good sound to be generated.

Furthermore, the lock mechanism of the piezoelectric vibrator 60 is constituted by the projections 105*a* and 106*a* of the guide members 105 and 106 and the top engaging portions 64*a* and concavities 64*b* formed in the holder 64 of the piezoelectric vibrator 60. While the projections 105*a* and 106*a* are engaged with the top engaging portions 64*a*, the piezoelectric vibrator 60 is held in the first state, and while the projections 105*a* and 106*a* are engaged with the concavities 64*b*, the piezoelectric vibrator 60 is held in the second state. When the piezoelectric vibrator 60 is in the first state, if the load received via the piezoelectric vibrator 60 is the load received during normal usage, which includes the load w1 of the mobile phone 10 that acts as an anchor, the lock mechanism effectively holds the piezoelectric vibrator 60 in the first state. Upon receiving a load equaling a predetermined load w3 or more, which is greater than the load w1, while the piezoelectric vibrator 60 is in the first state, the lock mechanism releases the piezoelectric vibrator 60 from the first state and displaces the piezoelectric vibrator 60 towards the second state. Accordingly, in the first state of the piezoelectric vibrator 60, when an undesired load equaling the predetermined load w3 or more is applied via the piezoelectric vibrator 60 due to the shock of the mobile phone 10 being dropped or the like, the piezoelectric vibrator 60 withdraws into the housing 20. In this way, damage to the laminated piezoelectric element 61 due to application of an undesired load to the piezoelectric vibrator 60 is effectively prevented. Moreover, during use in the first state as well, since the laminated piezoelectric element 61 contacts the contact surface 150 with the cap 63 therebetween, damage to the laminated piezoelectric element 61 during regular use can be prevented. Accordingly, the piezoelectric vibrator 60 can be stably used over an extended period of time.

Like Embodiment 1, the sound generator according to the present embodiment can mainly transmit vibration of the laminated piezoelectric element 61 directly to a contact surface (mounting surface) 150. Therefore, unlike when transmitting vibration of a laminated piezoelectric element to another elastic body, there is no dependence on the high-frequency side threshold frequency at which another elastic body can vibrate when emitting sound.

Embodiment 4

Figure 22:
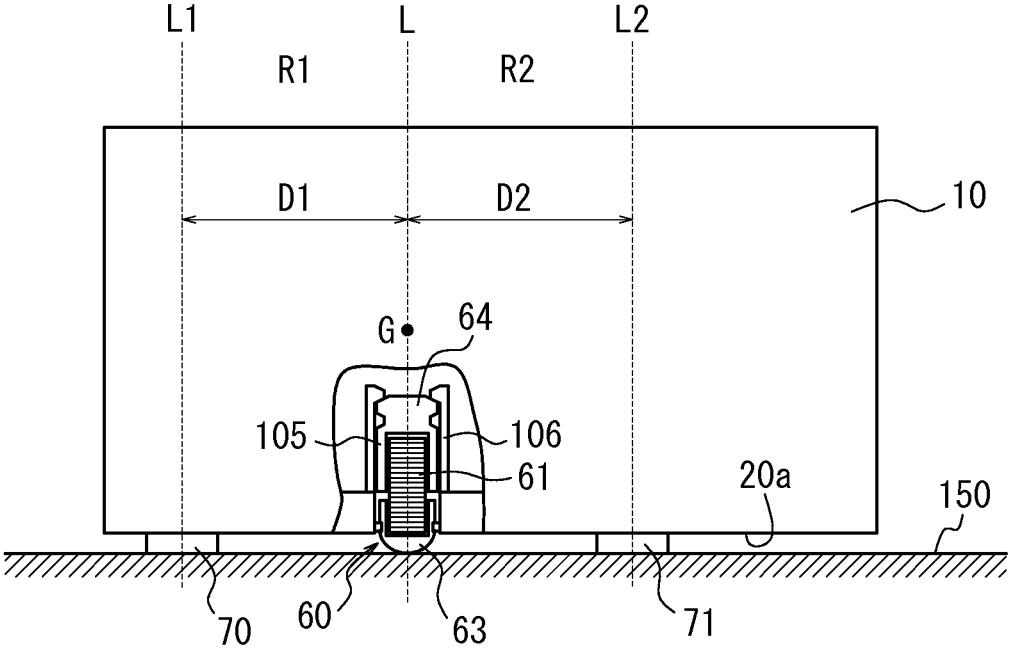
FIG. 22 illustrates a sound generator according to Embodiment 4 of the present invention.

FIG. 22 illustrates a sound generator according to Embodiment 4 of the present invention. The sound generator according to the present embodiment has the structure of the mobile phone 10 described in Embodiment 3 with the addition, as in Embodiment 2, of an elastic member 71 at the opposite edge, with the piezoelectric vibrator 60 therebetween, from the edge where the elastic member 70 is provided on the lateral side 20*a* of the housing 20. FIG. 22 illustrates the arrangement relationship between the piezoelectric vibrator 60, the elastic member 70, and the elastic member 71 in the first state.

In FIG. 22, the piezoelectric vibrator 60, elastic member 70, and elastic member 71 are arranged in a relationship similar to Embodiment 2. Accordingly, the same effects as in Embodiment 3 are obtained in the present embodiment as well.

Figure 23:
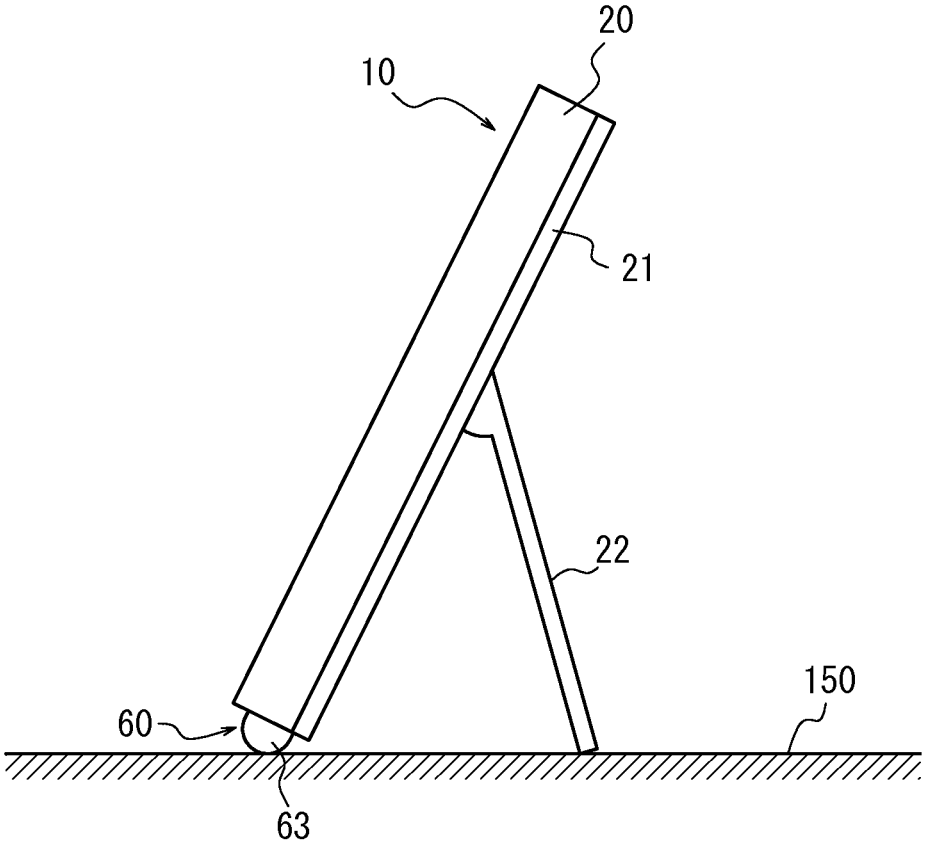
FIG. 23 illustrates a modification to a sound generator according to the present invention.

The present invention is not limited to Embodiments 3 and 4 above, but rather a variety of modifications and changes are possible. For example, a commercially available stand or the like may be attached to the housing 20, and the mobile phone 10 may be stood on a mounting surface, such as a desk, with the lateral side 20*a* downwards. Alternatively, as illustrated in FIG. 23, a stand 22 may be provided rotatably in the battery lid 21. In this case, the stand 22 is preferably connected to the holder 64 of the piezoelectric vibrator 60 within the housing 20 by a well-known coupling mechanism, for example a coupling mechanism that converts rotation into linear movement, and in coordination with the rotation of the stand 22, the piezoelectric vibrator 60 is preferably held in the first state or the second state. In other words, in FIG. 23, when the stand 22 is open with respect to the battery lid 21 and the mobile phone 10 is stood on the mounting surface 150, the piezoelectric vibrator 60 is in the first state and the cap 63 abuts the mounting surface 150, whereas when the stand 22 is closed with respect to the battery lid 21, the piezoelectric vibrator 60 is in the second state. With this structure, usability can be further improved.

The cap 63 may be omitted from the piezoelectric vibrator 60, so that in the first state, the end surface of the laminated piezoelectric element 61 contacts the contact surface directly or with a vibration transmission member, formed from an insulating member or the like, therebetween. The piezoelectric element is not limited to the above-described stack-type laminated piezoelectric element. A unimorph, bimorph, or laminated bimorph element may be used. In the case of using unimorph or bimorph, the entire piezoelectric element may project from the housing 20 in the first state.

Depending on the dimensions of the housing 20 and the dimensions of the piezoelectric vibrator 60, the piezoelectric vibrator 60 may, for example, be made to protrude from the battery lid 21.

Embodiment 5

Figure 24:
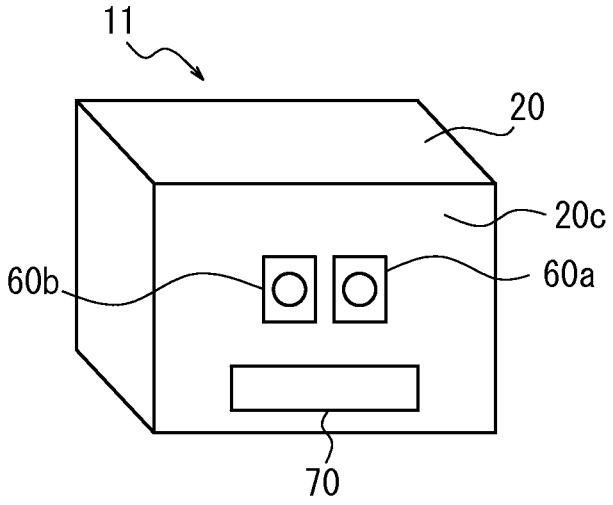
FIG. 24 is an external perspective view of a vibration speaker as Embodiment 5 of a sound generator according to the present invention.

FIG. 24 is an external perspective view of a vibration speaker, which is a sound generator according to Embodiment 5 of the present invention. The sound generator according to the present invention functions as a vibration speaker 11 and includes a piezoelectric vibrator 60*a*, a piezoelectric vibrator 60*b*, and a sheet-like elastic member 70. As described below, the vibration speaker 11 acts as an anchor (the anchor in the sound generator) providing a load to the piezoelectric vibrator 60*a* and the piezoelectric vibrator 60*b*. The vibration speaker 11 includes a housing 20 having an approximately rectangular external shape. The piezoelectric vibrator 60*a*, the piezoelectric vibrator 60*b*, and the elastic member 70 are formed on the bottom face 20*c* of the vibration speaker 11, which is one side of the housing 20. The following describes the differences from Embodiment 1, omitting a description of common features.

When the vibration speaker 11 is mounted on a horizontal mounting surface, such as a desk, with the bottom face 20*c* downwards, the vibration speaker 11 is supported at three points on the mounting surface by the piezoelectric vibrator 60*a*, the piezoelectric vibrator 60*b*, and the elastic member 70. The arrangement of the piezoelectric vibrator 60*a*, the piezoelectric vibrator 60*b*, and the elastic member 70 is described in detail below.

Figure 25:
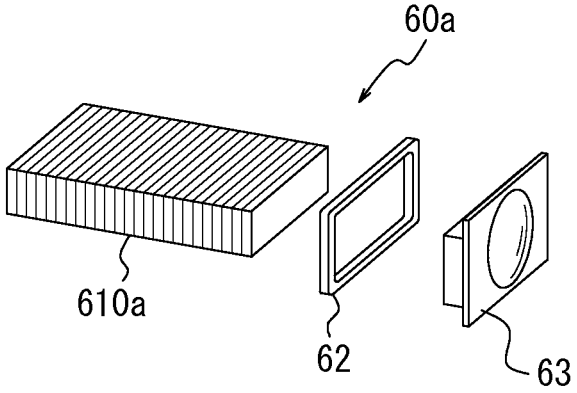
FIG. 25 is a perspective view schematically illustrating the piezoelectric vibrator of the vibration speaker in FIG. 24.

FIG. 25 is a perspective view schematically illustrating the piezoelectric vibrator 60*a* of the vibration speaker 11 in FIG. 24. The piezoelectric vibrator 60*a* includes a laminated piezoelectric element 610*a*, an O-ring 62 for waterproofing, and an insulating cap 63 that is a cover member. The laminated piezoelectric element 610*a* has the same structure as the laminated piezoelectric element 61 in Embodiment 1. In FIG. 25, the structure of the piezoelectric vibrator 60*a* is illustrated, yet the piezoelectric vibrator 60*b* has a similar structure. At the bottom face 20*c* of the housing 20, the vibration speaker 11 according to the present embodiment includes a holding unit that houses and holds the piezoelectric vibrator 60*a* and the piezoelectric vibrator 60*b*. The holding unit extends along the longitudinal direction of the housing 20.

Figure 26:
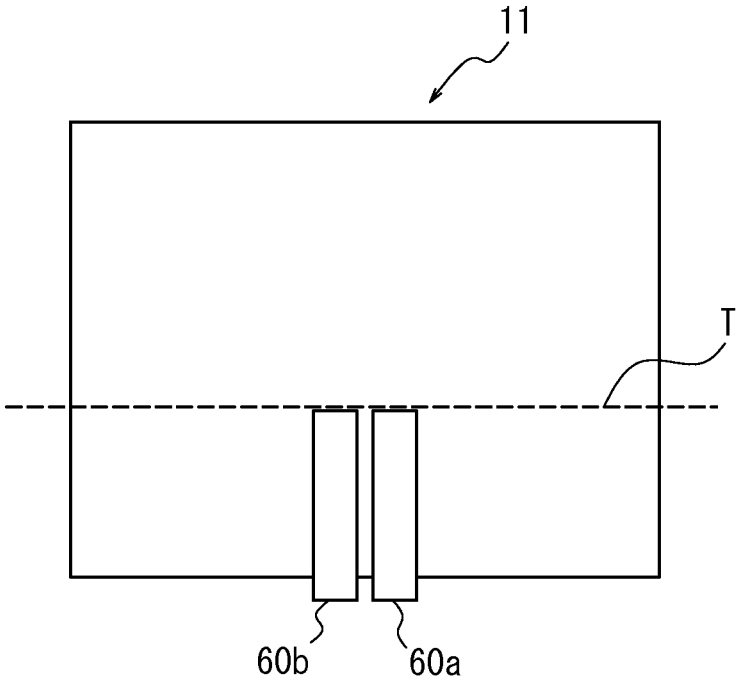
FIG. 26 is a schematic cross-sectional view of the vibration speaker in FIG. 24.

In other words, in the vibration speaker 11 according to the present embodiment, towards the bottom face 20*c* of the housing 20, the piezoelectric vibrator 60*a* and the piezoelectric vibrator 60*b* are disposed on a virtual plane T perpendicular to the expansion and contraction direction of the piezoelectric elements that form the piezoelectric vibrator 60*a* and the piezoelectric vibrator 60*b*, as illustrated in FIG. 26. FIG. 26 is a schematic cross-sectional view of the vibration speaker 11 in FIG. 24.

Figure 27:
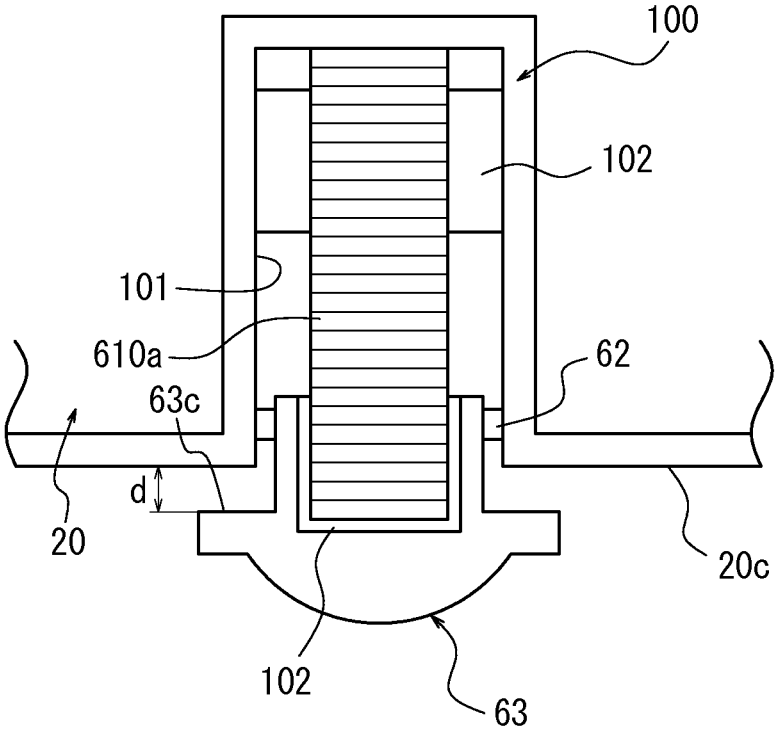
FIG. 27 is a partially enlarged cross-sectional view of the piezoelectric vibrator in FIG. 24.

As illustrated in the partially enlarged cross-sectional view in FIG. 27, the end of the laminated piezoelectric element 61 including the first lead connector 61*e* and the second lead connector 61*f* is fixed in the slit 101 of the holding unit 100 in the housing 20 via adhesive 102 (for example, epoxy resin). The cap 63 is inserted onto the other end of the laminated piezoelectric element 610*a* and fixed by adhesive 102.

With the cap 63 mounted on the laminated piezoelectric element 610*a*, an entering portion located in the slit 101 and a protrusion protruding from the housing 20 are formed in the cap 63. The O-ring 62 for waterproofing is disposed on the outer circumference of the entering portion located in the slit 101. In a state in which the piezoelectric vibrator 60*a* is mounted in the holding unit 100, the protrusion of the cap 63 protrudes from the bottom face 20*c* of the housing 20. The protrusion 63*b* of the cap 63 has an opposing face 63*c* that is a surface facing the bottom face 20*c* of the housing 20. As illustrated in FIG. 27, in a state in which no voltage is applied to the laminated piezoelectric element 610*a* so that the laminated piezoelectric element 610*a* is not expanding or contracting, the opposing face 63*c* is at a distance of d from the bottom face 20*c*.

Figure 28:
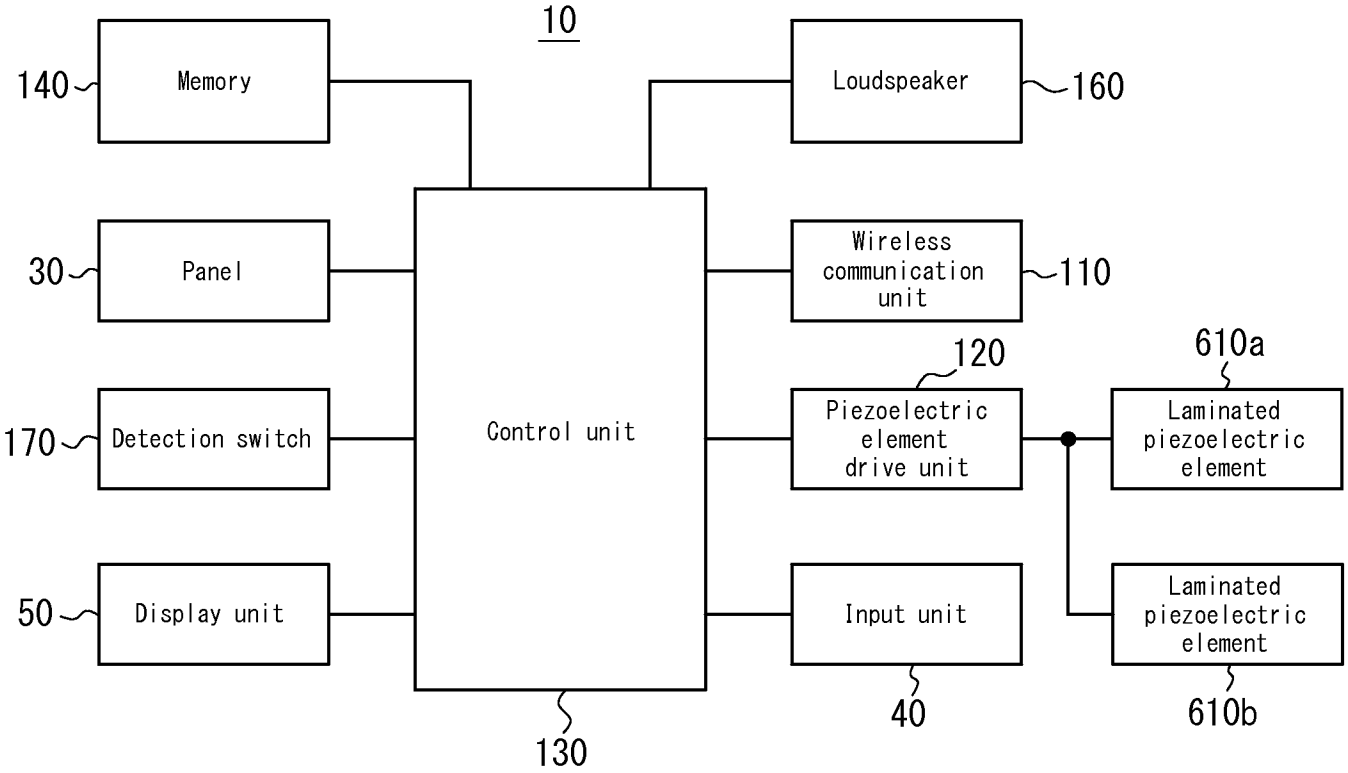
FIG. 28 is a functional block diagram of the main parts of the vibration speaker in FIG. 24.

FIG. 28 is a functional block diagram of the main portions of the vibration speaker 11 according to the present embodiment. The vibration speaker 11 includes a panel 30 that detects the contact position of the user's finger or the like due to a change in capacitance or the like; an input unit 40 that accepts input of an operation such as a playback instruction; a display unit 50 that displays images, the operation state, and the like; the laminated piezoelectric element 610*a* forming the piezoelectric vibrator 60*a*; and a laminated piezoelectric element 610*b* forming the piezoelectric vibrator 60*b*. Furthermore, the vibration speaker 11 includes a wireless communication unit 110, a piezoelectric element drive unit 120, a control unit 130, a memory 140, a detection switch 170, and a loudspeaker 160. The panel 30, input unit 40, display unit 50, wireless communication unit 110, piezoelectric element drive unit 120, memory 140, detection switch 170, and loudspeaker 160 connect to the control unit 130. The laminated piezoelectric element 610*a* and the laminated piezoelectric element 610*b* connect to the control unit 130 via the piezoelectric element drive unit 120. The panel 30 and the display unit 50 integrally form a touch panel.

The wireless communication unit 110 may have a well-known structure and connects wirelessly to other terminals or to a communication network via a close-range wireless communication standard, infrared, or the like. The control unit 130 is a processor that controls overall operations of the vibration speaker 11. The control unit 130 applies a playback sound signal (voltage corresponding to a playback sound signal of the other party's voice, a ringtone, music including songs, or the like) to the laminated piezoelectric element 610*a* and the laminated piezoelectric element 610*b* via the piezoelectric element drive unit 120. The playback sound signal may be based on music data stored in internal memory or may be music data stored on an external server or the like and played back over a network.

The memory 140 stores programs, data, and the like used by the control unit 130. The detection switch 170 is configured using, for example, an illuminance sensor, an infrared sensor, a mechanical switch, or the like, and detects when the vibration speaker 11 is placed on a mounting surface, such as a desk, table, or the like, outputting the result of detection to the control unit 130. Based on the detection result from the detection switch 170, the control unit 130 for example turns operation of the laminated piezoelectric element 610*a* and the laminated piezoelectric element 610*b* on and off. The loudspeaker 160 is a speaker that outputs audio due to control by the control unit 130.

In the present embodiment, the maximum voltage of the playback sound signal applied to the laminated piezoelectric element 610*a* and the laminated piezoelectric element 610*b* by the piezoelectric element drive unit 120 may, for example, be from 1 Vpp to 500 Vpp, yet the voltage is not limited to this range and may be adjusted appropriately in accordance with the weight of the vibration speaker 11 and the performance of the laminated piezoelectric element 610*a* and the laminated piezoelectric element 610*b*. For the playback sound signal applied to the laminated piezoelectric element 610*a* and the laminated piezoelectric element 610*b*, direct current may be biased, and the maximum voltage may be set centered on the bias voltage.

The loudspeaker 160 is driven by being controlled by the control unit 130 and emits audio upon input of a playback sound signal. This audio signal may be the same as the playback sound signal that is applied to the laminated piezoelectric element 610*a* and the laminated piezoelectric element 610*b* or may be different. This audio signal may be applied to the loudspeaker 160 simultaneously with application of the playback sound signal to the laminated piezoelectric element 610*a* and the laminated piezoelectric element 610*b* so that the loudspeaker 160 is driven simultaneously with the laminated piezoelectric element 610*a* and the laminated piezoelectric element 610*b*.

Figure 29:
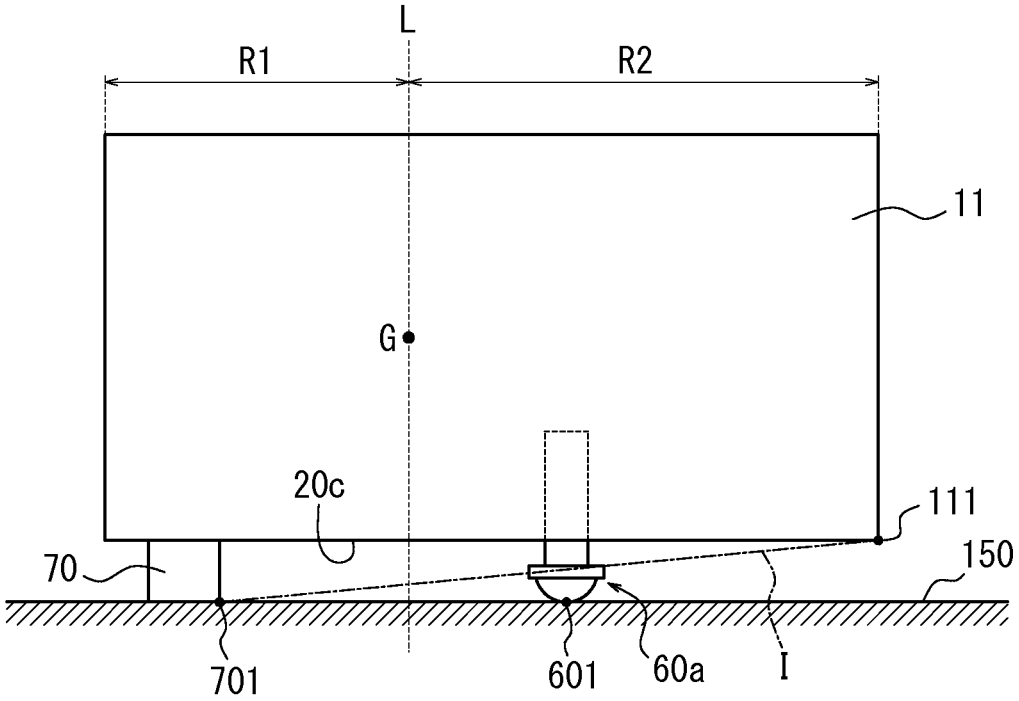
FIG. 29 illustrates the arrangement of the piezoelectric vibrator and the elastic member in the sound generator in FIG. 24.

Next, with reference to FIG. 29, the arrangement of the piezoelectric vibrator 60*a*, the piezoelectric vibrator 60*b*, and the elastic member 70 is described. FIG. 29 illustrates a state in which the vibration speaker 11 is mounted on a horizontal mounting surface 150, such as a desk, with the bottom face 20*c* downwards. The vibration speaker 11 is supported on the mounting surface 150 by the lowermost edge 601 of the piezoelectric vibrator 60, the lowermost edge of the piezoelectric vibrator 60*b*, and the lowermost edge 701 of the elastic member 70 abutting the mounting surface 150. In FIG. 29, for the sake of simplicity, the piezoelectric vibrator 60*b* is not illustrated, yet the description below applies equally to the piezoelectric vibrator 60*b*.

The lowermost edge 111 of the vibration speaker 11 is, within the vibration speaker 11, the location that would abut the horizontal mounting surface 150, such as a desk, when the vibration speaker 11 is mounted on the mounting surface 150 with the bottom face 20*c* downwards if the piezoelectric vibrator 60*a* did not exist. A non-limiting example of the lowermost edge 111 of the vibration speaker 11 is a corner of the housing 20. When a protrusion protrudes from the bottom face 20*c*, this protrusion may be the lowermost edge 111 of the vibration speaker 11. The protrusion may, for example, be a bottom key, a connector cap, or the like.

In FIG. 29, a dashed line L is a line (virtual line) that traverses the center of gravity G of the vibration speaker 11 and is perpendicular to the horizontal mounting surface 150, such as a desk, when the vibration speaker 11 is mounted on the mounting surface 150 with the bottom face 20*c* downwards. An alternate long and short dash line I is a line (virtual line) that connects the lowermost edge 701 of the elastic member 70 and the lowermost edge 111 of the vibration speaker 11 assuming the piezoelectric vibrator 60*a* does not exist.

In FIG. 29, the region R1 is a region at one side of the vibration speaker 11, separated by the dashed line L. The region R2 is a region at the other side of the vibration speaker 11, separated by the dashed line L. The elastic member 70 is provided on the bottom face 20*c* in the region R1. The piezoelectric vibrator 60*a* is provided on the bottom face 20*c* in the region R2.

In the region R2 of the bottom face 20*c*, the piezoelectric vibrator 60*a* is preferably provided at a position as close as possible to the dashed line L. The load on the piezoelectric vibrator 60*a* thus increases as compared to when the piezoelectric vibrator 60*a* is provided at a position distant from the dashed line L on the bottom face 20*c* in the region R2. Hence, the vibration speaker 11 can effectively be used as an anchor for the sound generator.

In the region R1 of the bottom face 20*c*, the elastic member 70 is preferably provided at a position as far as possible from the dashed line L. A sufficient distance can thus be ensured between the elastic member 70 and the piezoelectric vibrator 60*a* even when the piezoelectric vibrator 60*a* is placed at a position as close as possible to the dashed line L. Hence, the sound generator can be stably mounted on the mounting surface 150.

When the laminated piezoelectric element 610*a* is fully expanded from a state in which no voltage is applied thereto and the laminated piezoelectric element 610*a* is not expanding or contracting, or at the time of maximum amplitude of the laminated piezoelectric element 610*a*, the lowermost edge 601 of the piezoelectric vibrator 60*a* is preferably located towards the mounting surface 150 from the alternate long and short dash line I. In other words, when the laminated piezoelectric element 610*a* is fully expanded from a state in which no voltage is applied thereto and the laminated piezoelectric element 610*a* is not expanding or contracting, or at the time of maximum amplitude of the laminated piezoelectric element 610*a*, the lowermost edge 601 preferably projects towards the mounting surface 150 from the alternate long and short dash line I. In this way, the mounting surface 150 can appropriately be vibrated by the piezoelectric vibrator 60*a*.

When the laminated piezoelectric element 610*a* is fully contracted from a state in which no voltage is applied thereto and the laminated piezoelectric element 610*a* is not expanding or contracting, or at the time of minimum amplitude of the laminated piezoelectric element 610*a*, the lowermost edge 601 of the piezoelectric vibrator 60*a* is preferably located towards the mounting surface 150 from the alternate long and short dash line I. In other words, when the laminated piezoelectric element 610*a* is fully contracted from a state in which no voltage is applied thereto and the laminated piezoelectric element 610*a* is not expanding or contracting, or at the time of minimum amplitude of the laminated piezoelectric element 610*a*, the lowermost edge 601 preferably projects towards the mounting surface 150 from the alternate long and short dash line I. It is thus more difficult for the lowermost edge 111 of the vibration speaker 11 to contact the mounting surface 150, which for example depending on the type of paint on the housing 20, makes it more difficult for the paint to peel off. Abnormal noise is also less likely to be emitted between the lowermost edge 111 and the mounting surface 150.

Figure 30A:
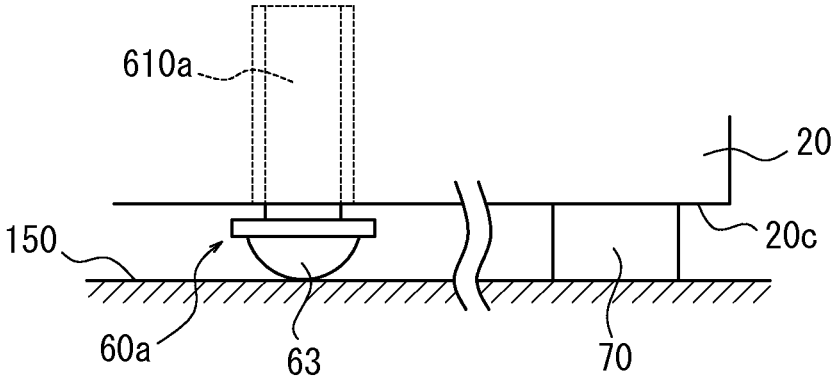
FIG. 30A schematically illustrates operation of the vibration speaker in FIG. 24 as a sound generator.
Figure 30B:
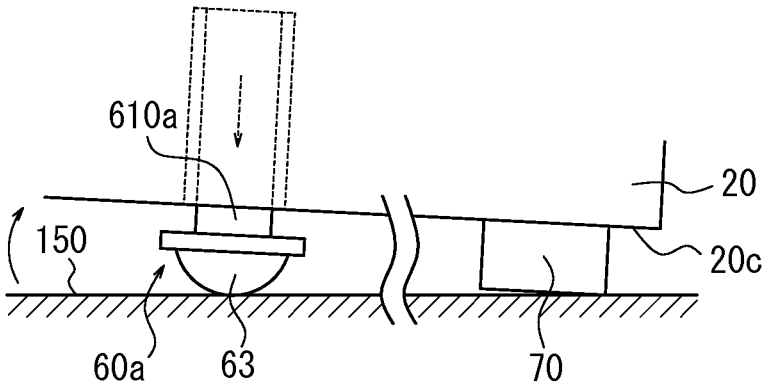
FIG. 30B schematically illustrates operation of the vibration speaker in FIG. 24 as a sound generator.
Figure 30C:
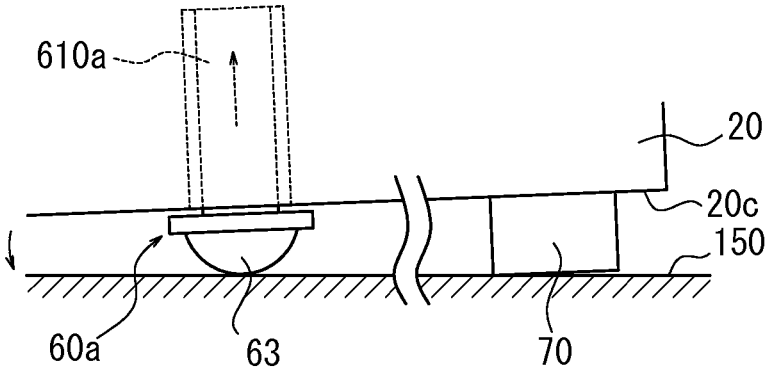
FIG. 30C schematically illustrates operation of the vibration speaker in FIG. 24 as a sound generator.

FIGS. 30A, 30B, and 30C schematically illustrate operation of the vibration speaker 11 according to the present embodiment as a sound generator. The following description uses the piezoelectric vibrator 60*a* as an example yet equally applies to the piezoelectric vibrator 60*b* as well. When causing the vibration speaker 11 to function as a sound generator, the vibration speaker 11 is mounted on a mounting surface (contact surface) 150, such as a desk, with the bottom face 20*c* of the housing 20 downwards, so that the cap 63 of the piezoelectric vibrator 60*a* and the elastic member 70 contact the mounting surface (contact surface) 150, as illustrated in FIG. 30A. In this way, the weight of the vibration speaker 11 is provided to the piezoelectric vibrator 60*a* as a load. In other words, the vibration speaker 11 acts as an anchor for the sound generator according to the present invention. In the state illustrated in FIG. 30A, the laminated piezoelectric element 610*a* does not expand or contract, since no voltage is applied thereto.

In this state, when the laminated piezoelectric element 610*a* of the piezoelectric vibrator 60*a* is driven by a playback sound signal, the laminated piezoelectric element 610*a* vibrates by expanding and contracting in accordance with the playback sound signal with the portion of the elastic member 70 contacting the mounting surface (contact surface) 150 acting as a pivot, and without the cap 63 separating from the mounting surface (contact surface) 150, as illustrated in FIGS. 30B and 30C. As in Embodiment 1, in the present embodiment as well, as long as problems such as the lowermost edge 101 contacting the mounting surface 150 and emitting abnormal noise do not occur, the cap 63 may separate slightly from the mounting surface 150. The difference in length between when the laminated piezoelectric element 610*a* is fully expanded and fully contracted may, for example, be from 0.05 μm to 100 μm. In this way, the expanding and contracting vibration of the laminated piezoelectric element 610*a* is transmitted to the mounting surface 150 through the cap 63, and the mounting surface 150 vibrates, causing the mounting surface 150 to function as a vibration speaker by emitting sound. If the difference in length between full expansion and full contraction is less than 0.05 μm, it may not be possible to vibrate the mounting surface appropriately. Conversely, if the difference exceeds 100 μm, vibration grows large depending on the frequency, and the sound generator may wobble. Even if the difference is less than 100 μm, the sound generator may wobble due to the relationship between load and frequency.

As described above, when the laminated piezoelectric element 610*a* is fully expanded, the tip of the cap 63 is preferably located towards the mounting surface 150 from a line (the alternate long and short dash line I in FIG. 29) connecting the lowermost edge 701 of the elastic member 70 and the lowermost edge 111 of the vibration speaker 11 assuming the piezoelectric vibrator 60*a* does not exist. When the laminated piezoelectric element 610*a* is fully contracted, the tip of the cap 63 is preferably located towards the mounting surface 150 from this virtual line.

The distance d between the bottom face 20*c* and the opposing face 63*c* of the cap 63 illustrated in FIG. 27 is preferably greater than the amount of displacement when the laminated piezoelectric element 610*a* is fully contracted from a state in which no voltage is applied thereto so that the laminated piezoelectric element 610*a* is not expanding or contracting. In this way, it is difficult for the bottom face 20*c* of the housing 20 and the cap 63 to contact even when the laminated piezoelectric element 610*a* is fully contracted (the state in FIG. 30C). Accordingly, the cap 63 does not easily detach from the piezoelectric element 610*a*.

The location at which the piezoelectric vibrator 60 is disposed on the bottom face 20*c*, the length of the laminated piezoelectric element 610*a* in the lamination direction, the dimensions of the cap 63, and the like are appropriately determined so as to satisfy the above conditions.

According to the vibration speaker as a sound generator in the present embodiment, as in Embodiment 1, a piezoelectric element is used as the source of vibration, hence reducing the number of components as compared to a vibration generating device having a dynamic speaker configuration and allowing for a simple structure with few components. Furthermore, the stack-type laminated piezoelectric element 610*a* is used as the piezoelectric element and vibrates by expanding and contracting along the lamination direction due to a playback sound signal. Since this expanding and contracting vibration is transmitted to the mounting surface (contact surface) 150, the vibration transmission efficiency with respect to the mounting surface (contact surface) 150 in the expansion and contraction direction (deformation direction) is good, and the mounting surface (contact surface) 150 can be vibrated efficiently. Moreover, since the laminated piezoelectric element 610*a* contacts the mounting surface (contact surface) 150 with the cap 63 therebetween, damage to the laminated piezoelectric element 610*a* can also be prevented. By mounting the vibration speaker 11 on the mounting surface (contact surface) 150 so that the cap 63 of the piezoelectric vibrator 60*a* contacts the mounting surface 150, the weight of the vibration speaker 11 is applied as a load to the cap 63. Hence, the cap 63 can reliably contact the mounting surface (contact surface) 150, and the expanding and contracting vibration of the piezoelectric vibrator 60*a* can efficiently be transmitted to the mounting surface (contact surface) 150.

The vibration speaker as a sound generator according to the present embodiment can mainly transmit vibration of a laminated piezoelectric element directly to a contact surface (mounting surface). Therefore, unlike a technique to transmit vibration of a laminated piezoelectric element to another elastic body, there is no dependence on the high-frequency side threshold frequency at which another elastic body can vibrate when emitting sound. The high-frequency side threshold frequency at which another elastic body can vibrate is the inverse of the shortest time among the times from when the other elastic body is caused to deform by a piezoelectric element until the other elastic body returns to a state in which deformation is again possible. In light of this fact, the anchor of the sound generator according to the present embodiment preferably has enough stiffness (flexural strength) so as not to undergo flexing deformation due to deformation of the piezoelectric element.

The sound generator according to the present embodiment includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input.

Figure 31A:
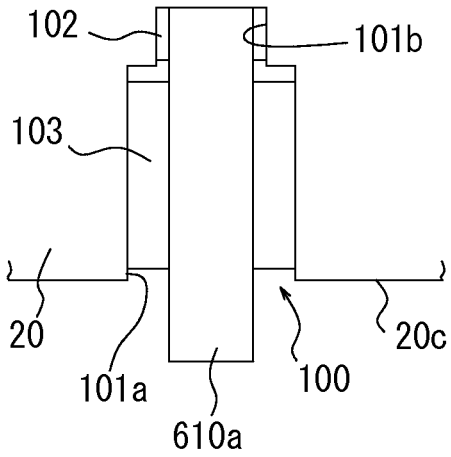
FIG. 31A illustrates a modification to the holding state of the piezoelectric vibrator in FIG. 24.
Figure 31B:
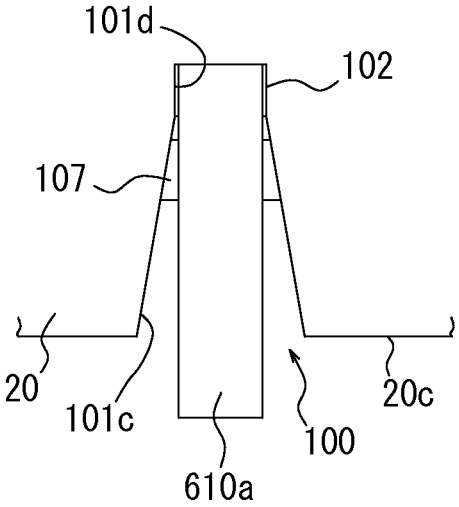
FIG. 31B illustrates another modification to the holding state of the piezoelectric vibrator in FIG. 24.
Figure 31C:
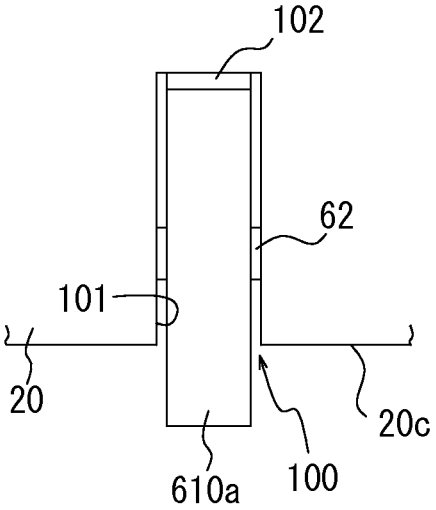
FIG. 31C illustrates yet another modification to the holding state of the piezoelectric vibrator in FIG. 24.

In the present embodiment, the structure to fix the laminated piezoelectric element 610*a* to the holding unit 100 is not limited to that illustrated in FIG. 27. For example, as illustrated in FIGS. 31A, 31B, and 31C, the laminated piezoelectric element 610*a* may be held by the holding unit 100. The following description uses the laminated piezoelectric element 610*a* as an example yet equally applies to the laminated piezoelectric element 610*b* as well. The holding unit 100 illustrated in FIG. 31A includes a wide slit 101*a* that opens to the bottom face 20*c* and a narrow slit 101*b* that is contiguous with the slit 101*a*. One end of the laminated piezoelectric element 610*a* is disposed in the narrow slit 101*b*, and the sides of the laminated piezoelectric element 610*a* are fixed to the slit 101*b* by adhesive 102. Filler 107 such as silicone rubber, gel, or the like that does not impede expansion and contraction of the laminated piezoelectric element 610*a* is packed in the gap between the wide slit 101*a* and the laminated piezoelectric element 610*a*. By thus holding the piezoelectric vibrator 60*a* in the holding unit 100, the vibration speaker 11 can more reliably be waterproofed without using waterproof packing such as an O-ring. By covering the portion of the laminated piezoelectric element 610*a* protruding from the bottom face 20*c* with an insulating cap, the laminated piezoelectric element 610*a* can also reliably be insulated.

The holding unit 100 illustrated in FIG. 31B includes a tapered slit 101*c* that expands toward the bottom face 20*c* and a narrow slit 101*d* that is contiguous with the tapered slit 101*c*. One end of the laminated piezoelectric element 610*a* is disposed in the narrow slit 101*d*, and the sides of the laminated piezoelectric element 610*a* are fixed to the slit 101*d* by adhesive 102. Filler 107 such as silicone rubber, gel, or the like that does not impede expansion and contraction of the laminated piezoelectric element 610*a* is packed in the gap between the tapered slit 101*c* and the laminated piezoelectric element 610*a*. This structure achieves the same effects as the holding unit 100 in FIG. 31A, and by including the tapered slit 101*c*, offers the advantage that the laminated piezoelectric element 610*a* is easy to assemble into the holding unit 100.

As in the above embodiment, the holding unit 100 illustrated in FIG. 31C has a uniform-width slit 101, yet the end face at one end of the laminated piezoelectric element 610*a* is fixed to the slit 101 by adhesive 102. Furthermore, an O-ring 62 for waterproofing is disposed in the slit 101 at an appropriate location along the laminated piezoelectric element 610*a*. This holding state for the laminated piezoelectric element 610*a* particularly offers an advantage in routing lead wires in the case that connectors for lead wires are formed in lateral electrodes of the laminated piezoelectric element 610*a*, as illustrated in FIG. 4.

Figure 32:
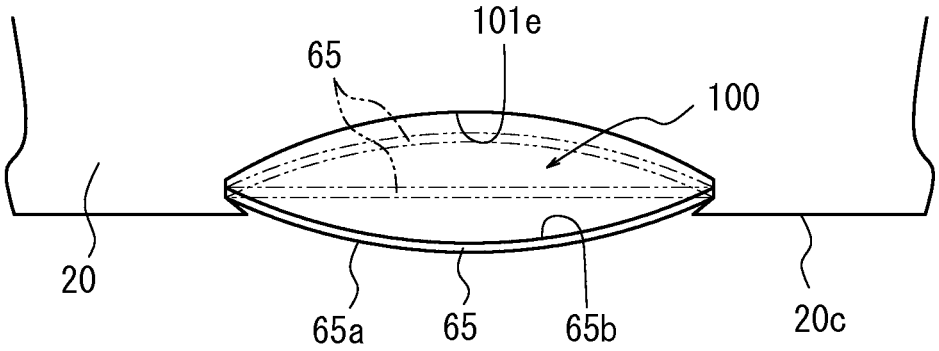
FIG. 32 schematically illustrates the structure of the main parts of a modification to the piezoelectric vibrator in FIG. 24.

In Embodiment 5 and the modifications in FIGS. 31A to 31C, the cap 63 may be omitted from the piezoelectric vibrator 60*a*, so that the end surface of the laminated piezoelectric element 610*a* contacts the contact surface directly or with a vibration transmission member, formed from an insulating member or the like, therebetween. The piezoelectric element is not limited to the above-described stack-type laminated piezoelectric element. A unimorph, bimorph, or laminated bimorph element may be used. FIG. 32 schematically illustrates the structure of the main parts when using bimorph. Bimorph 65 is shaped as an elongated rectangle, with one surface 65*a* exposed at the bottom face 20*c* of the housing 20, and the edges of the rectangle held by the holding unit 100. The holding unit 100 includes an opening 101*e* that holds the bimorph 65, and the inner surface of the opening 101*e* towards a back side 65*b* of the bimorph 65 is curved. According to this structure, by mounting the housing 20 on the mounting surface so that the bimorph 65 contacts the mounting surface and then driving the bimorph 65 with a playback sound signal, the bimorph 65 undergoes bending (flexure) vibration. In this way, the vibration of the bimorph 65 is transmitted to the mounting surface (contact surface), and the mounting surface (contact surface) functions as a vibration speaker, causing playback sound to be emitted from the mounting surface (contact surface). Note that a covering layer of polyurethane or the like may be formed on the surface 65*a* of the bimorph 65.

In Embodiment 5, an example of the piezoelectric vibrator 60*a* and the piezoelectric vibrator 60*b* being disposed on the bottom face 20*c* of the housing 20 and protruding from the bottom face 20*c* has been described, yet the present invention is not limited in this way. Depending on the dimensions of the housing 20 and the dimensions of the piezoelectric vibrator 60*a* and piezoelectric vibrator 60*b*, the piezoelectric vibrator 60*a* may, for example, protrude from the side of the housing or from the battery lid.

In Embodiment 5, the contact surface of the contacted member is not limited to a horizontal contact surface of a desk and may, for example, be a surface of the desk perpendicular to the ground. An example of a contacted member having a surface perpendicular to the ground is a partition for sectioning off space.

In Embodiment 5, the vibration speaker 11 is described as an example of a sound generator, and the vibration speaker 11 functions as an anchor, yet the anchor is not limited in this way. For example, a sound generator may be configured with any of a wide variety of electronic devices serving as an anchor, such as a mobile phone, a portable music player, a tabletop television, a telephone conferencing system, a notebook computer, a projector, a hanging clock or hanging television, an alarm clock, or a photo frame. The anchor is not limited to an electronic device and may, for example, be a vase, a chair, or the like. Furthermore, the present invention is not limited to a sound generator and may also be configured as a piezoelectric vibrator for a sound generator, the piezoelectric vibrator including a piezoelectric element, or as a sound generation system provided with a sound generator and a contacted member that has a contact surface contacted by the sound generator. These configurations are also to be understood as within the scope of the present invention.

(Modification 1)

Figure 33:
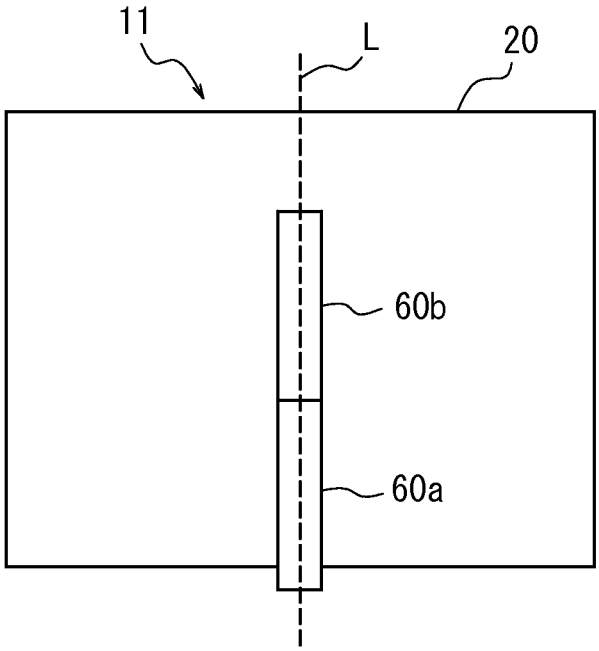
FIG. 33 is a schematic cross-sectional view of a vibration speaker that is a modification to a sound generator according to the present invention.

Next, with reference to FIG. 33, Modification 1 to the sound generator according to Embodiment 5 is described.

FIG. 33 is a schematic cross-sectional view of a vibration speaker according to Modification 1. The following only describes the differences from Embodiment 5.

As illustrated in FIG. 33, in the vibration speaker 11 according to Modification 1, the piezoelectric vibrator 60*a* and the piezoelectric vibrator 60*b* are disposed towards the bottom face of the housing 20 on a virtual line L parallel to the expansion and contraction direction of the piezoelectric elements that form the piezoelectric vibrator 60*a* and the piezoelectric vibrator 60*b*.

The sound generator according to Modification 1 thus includes two piezoelectric vibrators, the piezoelectric vibrator 60*a* and the piezoelectric vibrator 60*b*, on a virtual line parallel to the expansion and contraction direction of the piezoelectric elements forming the piezoelectric vibrator 60*a* and the piezoelectric vibrator 60*b*. Hence, as compared to the case of only one piezoelectric vibrator, the stroke can be doubled, and the output power can be the same.

(Modification 2)

Figure 34:
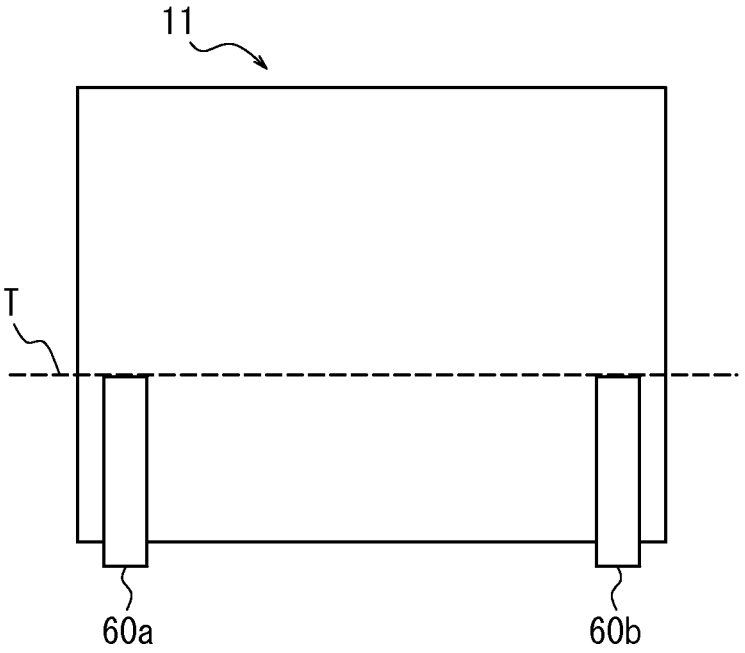
FIG. 34 is a schematic cross-sectional view of a vibration speaker that is a modification to a sound generator according to the present invention.

Next, with reference to FIG. 34, Modification 2 to the sound generator according to Embodiment 5 is described. FIG. 34 is a schematic cross-sectional view of a vibration speaker that is Modification 2. The following only describes the differences from Embodiment 5.

As illustrated in FIG. 34, in the vibration speaker 11 according to Modification 2, the piezoelectric vibrator 60*a* and the piezoelectric vibrator 60*b* are disposed towards the bottom face of the housing 20 on a virtual plane T perpendicular to the expansion and contraction direction of the piezoelectric elements that form the piezoelectric vibrator 60*a* and the piezoelectric vibrator 60*b*, and the distance therebetween is greater than in the embodiment illustrated in FIG. 26. In other words, in Modification 2, the piezoelectric vibrator 60*a* and the piezoelectric vibrator 60*b* are disposed at the edges of the bottom face of the housing 20.

The sound generator according to Modification 2 thus includes two piezoelectric vibrators, the piezoelectric vibrator 60*a* and the piezoelectric vibrator 60*b*, on a virtual plane perpendicular to the expansion and contraction direction of the piezoelectric elements forming the piezoelectric vibrator 60*a* and the piezoelectric vibrator 60*b*. Hence, as compared to the case of only one piezoelectric vibrator, the stroke can be the same, and the output power can be doubled. Furthermore, since the piezoelectric vibrator 60*a* and the piezoelectric vibrator 60*b* are provided, stereo sound can be achieved by providing the vibrators respectively with right audio input and left audio input. Furthermore, in Modification 2, the piezoelectric vibrator 60*a* and the piezoelectric vibrator 60*b* are disposed at the edges towards the bottom face of the housing 20, and therefore the quality of stereo sound can be improved as compared to the embodiment illustrated in FIG. 26.

(Modification 3)

Figure 35:
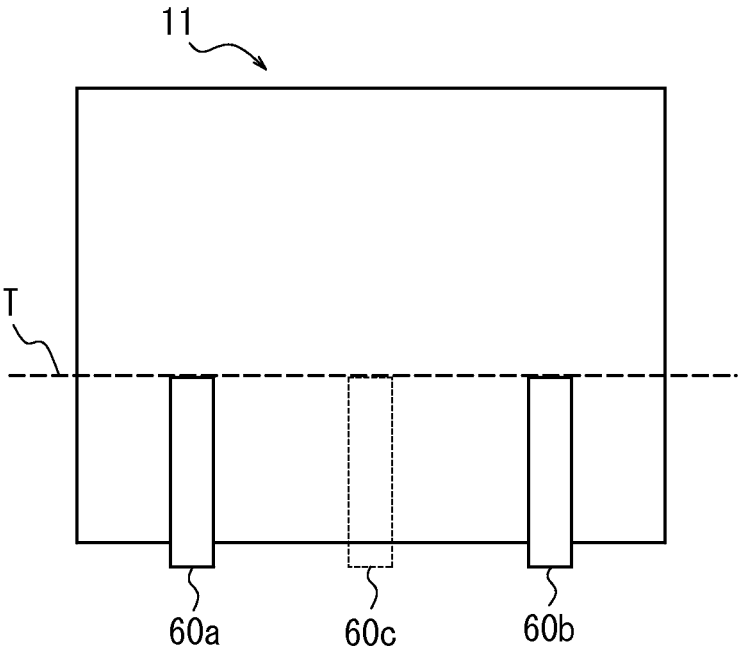
FIG. 35 is a schematic cross-sectional view of a vibration speaker that is a modification to a sound generator according to the present invention.
Figure 36:
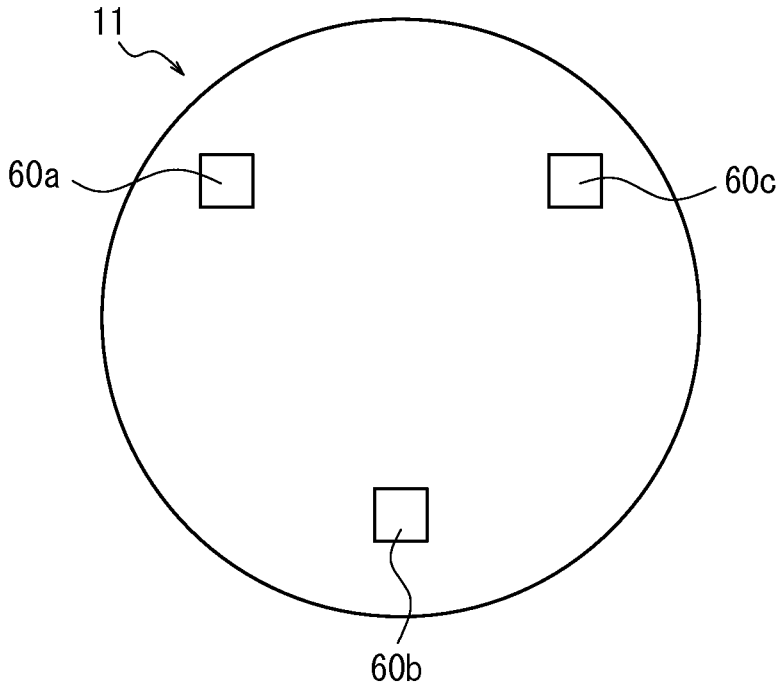
FIG. 36 is a schematic view of the bottom face of the vibration speaker in FIG. 35.

Next, with reference to FIGS. 35 and 36, Modification 3 to the sound generator according to Embodiment 5 is described. FIGS. 35 and 36 are schematic cross-sectional views of a vibration speaker that is Modification 3. The following only describes the differences from Embodiment 5.

As illustrated in FIGS. 35 and 36, the vibration speaker 11 according to Modification 3 includes three piezoelectric vibrators: piezoelectric vibrator 60*a*, piezoelectric vibrator 60*b*, and piezoelectric vibrator 60*c*. The piezoelectric vibrator 60*a*, piezoelectric vibrator 60*b*, and piezoelectric vibrator 60*c* are disposed towards the bottom face of the housing 20 on a virtual plane T perpendicular to the expansion and contraction direction of the piezoelectric elements that form the piezoelectric vibrator 60*a*, piezoelectric vibrator 60*b*, and piezoelectric vibrator 60*c*. In Modification 3, the piezoelectric vibrator 60*a*, piezoelectric vibrator 60*b*, and piezoelectric vibrator 60*c* are formed towards the bottom face of the housing 20 at positions corresponding to the vertices of an equilateral triangle. The positional relationship between the three piezoelectric vibrators is of course not limited to the case of forming vertices of an equilateral triangle, and any other appropriate positions may be adopted.

The sound generator according to Modification 3 thus includes three piezoelectric vibrators, the piezoelectric vibrator 60*a*, piezoelectric vibrator 60*b*, and piezoelectric vibrator 60*c* on a virtual plane perpendicular to the expansion and contraction direction of the piezoelectric elements forming the piezoelectric vibrator 60*a*, piezoelectric vibrator 60*b*, and piezoelectric vibrator 60*c*. Hence, as compared to the case of only one piezoelectric vibrator, the stroke can be the same, and the output power can be tripled. Since the piezoelectric vibrator 60*a*, piezoelectric vibrator 60*b*, and piezoelectric vibrator 60*c* can support the vibration speaker 11 at three points, the vibration speaker 11 can be supported stably without requiring another leg to prevent the vibration speaker 11 from falling over.

In Embodiment 5 and the modifications thereto, examples of two or three piezoelectric vibrators have been described, yet the number of piezoelectric vibrators may be four or more. As in Embodiment 1, the piezoelectric vibrators may be supported via an elastic member, such as a plate spring, so as to displace in a direction to withdraw into the housing upon action of an undesired load equaling at least a predetermined load. Also, as in Embodiment 3, the piezoelectric vibrators may selectively transition between the first state in which a portion thereof protrudes from the housing and the second state in which the piezoelectric vibrators do not protrude from the housing. Driving may be allowed in response to a sound signal when in the first state, and driving may be denied when not in the first state.

REFERENCE SIGNS LIST

10: Mobile phone
20: Body
20*a*: Bottom side
20*b*: Projecting support
21: Battery lid
21*a*: Guide hole
22: Stand
30: Panel
40: Input unit
50: Display unit
60: Piezoelectric vibrator
61: Laminated piezoelectric element (piezoelectric element)
62: O-ring
63: Cap
64: Holder
64*a*: Top engaging portion
64*b*: Concavity
65: Guide pin
66: Sliding plate
67: State detection unit
70, 71: Elastic member
100: Holding unit
101: Slit
102: Adhesive
103: Plate spring
105, 106: Guide member
105*a*, 106*a*: Projection
150: Mounting surface (contact surface)

The invention claimed is:

1. A sound generator comprising:

a housing;

at least one piezoelectric vibrator including a piezoelectric element, at least a portion of the piezoelectric vibrator protruding from the housing; and an anchor applying a load to the piezoelectric vibrator, wherein a portion or all of the piezoelectric vibrator withdraws into the housing under a force of a predetermined load or greater, while the load from the anchor is being applied to the piezoelectric vibrator, the piezoelectric vibrator deforms in response to a sound signal, and deformation of the piezoelectric vibrator vibrates a contact surface contacted by the piezoelectric vibrator, causing sound to be emitted from the contact surface, and the contact surface is a surface of a component that is separate from the sound generator.

2. The sound generator according to claim 1, wherein the predetermined load is greater than the load applied to the piezoelectric vibrator by the anchor.

3. The sound generator according to claim 1, wherein the load is applied by the anchor to the piezoelectric vibrator through an elastic support member.

4. The sound generator according to claim 3, wherein the elastic support member deforms upon application, through the piezoelectric vibrator, of a force of the predetermined load or greater, and a portion or all of the piezoelectric vibrator withdraws into the housing.

5. The sound generator according to claim 1, wherein the piezoelectric element is a laminated piezoelectric element that deforms by expanding and contracting along a lamination direction.

6. The sound generator according to claim 1, wherein the piezoelectric vibrator includes a cover member that vibrates the contact surface by transmitting vibration due to deformation of the piezoelectric element to the contact surface.

7. The sound generator according to claim 1, wherein the at least one piezoelectric vibrator comprises a plurality of piezoelectric vibrators.

8. A sound generator comprising:

a housing;

at least one piezoelectric vibrator including a piezoelectric element and selectively transitioning between a first state such that at least a portion of the piezoelectric vibrator protrudes from the housing and a second state such that the piezoelectric vibrator does not protrude from the housing;

a lock mechanism to selectively maintain the piezoelectric vibrator in the first state or the second state; and an anchor applying a load to the piezoelectric vibrator, wherein when the piezoelectric vibrator is in the first state and while the load from the anchor is being applied to the piezoelectric vibrator, upon the piezoelectric element deforming in response to a sound signal, the piezoelectric vibrator deforms and vibrates a contact surface contacted by the piezoelectric vibrator, causing sound to be emitted from the contact surface, and when the piezoelectric vibrator is in the first state and a force of a predetermined load or greater acts on the piezoelectric vibrator protruding from the housing, the lock mechanism releases the piezoelectric vibrator from the first state and displaces the piezoelectric vibrator towards the second state.

9. The sound generator according to claim 8, wherein the piezoelectric element is driven when the piezoelectric vibrator is in the first state and is not driven when the piezoelectric vibrator is in the second state.

10. The sound generator according to claim 8, further comprising:

a state detection unit configured to detect the first state or the second state of the piezoelectric vibrator, wherein driving of the piezoelectric element is controlled based on output from the state detection unit.

11. The sound generator according to claim 8, wherein the piezoelectric element is a laminated piezoelectric element that deforms by expanding and contracting along a lamination direction.

12. The sound generator according to claim 8, wherein the piezoelectric vibrator includes a cover member that vibrates the contact surface by transmitting vibration due to deformation of the piezoelectric element to the contact surface.

13. The sound generator according to claim 8, wherein the at least one piezoelectric vibrator comprises a plurality of piezoelectric vibrators.

* * * * *